US007278792B2

(12) United States Patent
Takada et al.

(10) Patent No.: US 7,278,792 B2
(45) Date of Patent: Oct. 9, 2007

(54) RAISED-LETTER INFORMATION PROCESSING APPARATUS, RAISED-LETTER INFORMATION PROCESSING METHOD, PROGRAM, AND STORAGE MEDIUM

(75) Inventors: Makoto Takada, Shiajiri (JP); Seiji Tanaka, Toyoshina-machi (JP); Yoichi Hine, Kashiwa (JP)

(73) Assignee: Seiko Epson Corporation, Tokyo (JP)

( * ) Notice: Subject to any disclaimer, the term of this patent is extended or adjusted under 35 U.S.C. 154(b) by 100 days.

(21) Appl. No.: 11/245,862

(22) Filed: Oct. 7, 2005

(65) Prior Publication Data

US 2006/0102020 A1 May 18, 2006

(30) Foreign Application Priority Data

Nov. 18, 2004 (JP) ..... 2004-334472
Nov. 18, 2004 (JP) ..... 2004-334473
May 10, 2005 (JP) ..... 2005-137909

(51) Int. Cl.
*B41J 3/32* (2006.01)

(52) U.S. Cl. ..... 400/109.1; 400/483

(58) Field of Classification Search ..... 400/109.1, 400/483
See application file for complete search history.

(56) References Cited

U.S. PATENT DOCUMENTS 5,909,972 A * 6/1999 Kotoh ..... 400/109.1
6,086,273 A * 7/2000 Hong ..... 400/109.1

FOREIGN PATENT DOCUMENTS

JP 3054580 9/1998
JP 10-275206 10/1998
JP 2001-088358 4/2001

* cited by examiner

*Primary Examiner*—Minh Chau
(74) *Attorney, Agent, or Firm*—Hogan & Hartson LLP

(57) ABSTRACT

In displaying cell images of raised letters under editing on a display screen together with a notation character string corresponding to the cell images, the maximum continuous embossing amount that can be embossed on a single processing sheet when embossing the raised letters on the processing sheet, is predetermined. A continuous embossing amount of the raised letters is determined, and when the continuous embossing amount is in excess of the maximum continuous embossing amount, the excess cell images corresponding to the portion exceeding the maximum continuous embossing amount out of the cell images and the notation character string, or excess notation characters corresponding to the excess cell images are displayed so as to be distinguishable from the remaining portion.

8 Claims, 22 Drawing Sheets

(Note: Alphabets "SHI" are transliteration of Japanese hiragana. Raised letter represents hiragana, not alphabets.)

1ST PROCESSING MODE:
INK CHARACTER PRINTING → RAISED-LETTER EMBOSSING

2ND PROCESSING MODE:
INK CHARACTER PRINTING ALONE

3RD PROCESSING MODE:
RAISED-LETTER EMBOSSING ALONE (Note: Alphabets "A", "I", "U" are transliterated from Japanese hiragana. Raised letters represent those of hiragana, not of alphabets. The same applies to FIGS. 9A-C, 10, 13, etc.)

T1:TAPE WIDTH 24 MM

T2:TAPE WIDTH 18 MM

T3:TAPE WIDTH 12 MM

RAISED-LETTER INFORMATION PROCESSING APPARATUS, RAISED-LETTER INFORMATION PROCESSING METHOD, PROGRAM, AND STORAGE MEDIUM

BACKGROUND OF THE INVENTION

1. Field of the Invention

This invention relates to a raised-letter information processing apparatus and a raised-letter information processing method of processing raised-letter information to be used in embossing raised letters, as well as a program and a storage medium therefor. In this specification, the term "raised letter(s)" is used in the meaning of Braille or Braille points, as compared with "ink characters" which are printed with ink.

2. Description of the Related Art

Conventionally, a processing sheet (raised-letter label) is known on which raised letters recognizable by the visually-impaired persons and ink characters (i.e., ordinary printed characters as compared with raided letters) visually recognizable by sighted persons, are arranged on the same processing sheet (tape or the like) in a side-by-side manner (or in an overlapping manner) so that both the visually-impaired persons and the sighted persons can recognize them. Also, a raised-letter information processing apparatus is known that performs ink character printing and raised-letter embossing in parallel and that can produce processing sheets on which they are arranged side by side.

The raised-letter embossing, by its nature of being undergoing embossing processing, must be subjected to a severe restriction on its mechanism or structure, i.e., on its specifications for function maintenance and safety securing, as compared with the ink character printing subjected to printing processing. For example, in the above-described type of apparatus, because a drum or solenoid type embossing means is used, a continuous embossing operation would inhibit the maintenance of normal operation conditions, due to heating caused by frictional heat or Joule heat. This might make it impossible to perform proper embossing conformable to the specifications. As a result, for example, a desired embossing height would be made unattainable. In such a case, it is necessary to properly impose a restriction on the maximum continuous embossing amount, such as the number of "cells" or embossed dots that can be continuously embossed in a proper manner, and to comply with this restriction.

In the above-described type of apparatus, which is configured to input/edit ink characters and then converts them into raised letters, the number of the ink characters and that of raised-letter cells, generally, do not directly correspond to each other. Therefore, even if the maximum continuous embossing amount is predetermined, it has been difficult to give consideration to the restriction on the maximum continuous embossing amount when editing ink characters before actually performing raised-letter embossing.

Even in a setting in which the range of a desired length (definite length and fixed length) is set on the processing sheet to thereby perform sheet processing such as ink character printing within the definite length range, that is, even in a so-called definite length setting, the ink characters allow the adjustment of the character size and the distance between characters, whereas the raised letters do not allow the adjustment of them because of customary specifications (commercially available specifications) or by their nature of being subjected to touch-read. This inevitably imposes a restriction on the maximum number of cells that can be arranged, i.e., the maximum (arrangement) cell number. In this case also, by the same reason as that described above, namely, because of the conversion from ink characters to raised letters, it has been difficult to give consideration to the maximum cell number during editing operation.

SUMMARY OF THE INVENTION

Accordingly, this invention has an advantage of providing a raised-letter information processing apparatus and raised-letter information processing method that are capable of editing raised-letter information with consideration given to the restriction of the maximum continuous embossing amount, and that have high operability, as well as a program and a storage medium therefor.

According to one aspect of this invention, there is proved a raised-letter information processing apparatus comprising embossing: means for embossing raised letters on a processing sheet, wherein a maximum continuous embossing amount that can be embossed on a single piece of the processing sheet is predetermined; determination means for determining a continuous embossing amount of raised letters under editing, and determining whether the continuous embossing amount is in excess of the maximum continuous embossing amount; display means for displaying, on a display screen, cell images of the raised letters together with a notation character string corresponding to the cell images; and display control means that, when the continuous embossing amount is in excess of the maximum continuous embossing amount, causes the display means to display at least one of the excess cell images corresponding to the portion exceeding the maximum continuous embossing amount out of the cell images and the notation character string, and excess notation characters corresponding to the excess cell images so as to be distinguishable from a remaining portion.

In another aspect of this invention, there is provided a raised-letter information processing method in which cell images of raised letters under editing are displayed on a display screen, together with a notation character string corresponding to the cell images. The method comprises the steps of: predetermining a maximum continuous embossing amount that can be embossed on a single piece of the processing sheet when embossing raised letters on the processing sheet; and determining a continuous embossing amount of the raised letters and, when the continuous embossing amount is in excess of the maximum continuous embossing amount, displaying at least one of the excess cell images corresponding to the portion exceeding the maximum continuous embossing amount out of the cell images and the notation character string, and excess notation characters corresponding to the excess cell images so as to be distinguishable from a remaining portion.

According to the above apparatus and method, a notation character string corresponding to the raised cell images is displayed, but since the maximum continuous embossing amount that can be embossed on a single processing sheet is predetermined, excess cell images corresponding to the portion exceeding the maximum continuous embossing amount of the raised letters under editing and/or corresponding excess images are displayed distinguishably from the remaining portion. Thereby, the user can easily and correctly grasp whether the continuous embossing amount is in excess of the maximum continuous embossing amount, by the display, during the editing of raised-letter information, without taking a lot of time and effort for calculation of the continuous embossing amount. This saves the user the time and trouble of redoing the editing operation after the actual embossing, thereby offering enhanced operability.

Preferably, the embossing means uses a solenoid as a driving source, and the maximum continuous embossing amount is predetermined based on the heating property of the solenoid.

According to this arrangement, since the embossing is performed by using the solenoid as a drive source, usage limitations may be imposed on continuous embossing because of potential heating. Nevertheless, if a maximum continuous embossing amount is properly predetermined in accordance with the usage limitations, excess cell images corresponding to the portion exceeding the maximum continuous embossing amount of raised letters and/or corresponding excess images are displayed distinguishably from the remaining portion. By this display, therefore, it is possible to easily and correctly grasp whether the continuous embossing amount is in excess of the maximum continuous embossing amount, or how much the continuous embossing amount is in excess of the maximum continuous embossing amount. This allows the user to guard against exceeding the usage limitations.

Preferably, the maximum continuous embossing amount is defined as a maximum embossed cell number, and the determination means comprises cell number acquisition means for acquiring, from the raised letters under editing, the cell number thereof, and cell number excess determination means for determining whether the acquired cell number is in excess of the maximum embossed cell number.

According to this arrangement, it is determined whether the cell number of raised letters is in excess of the maximum embossed cell number, and then excess cell images corresponding to the portion exceeding the maximum embossed cell number and/or a corresponding excess notation character string is displayed distinguishably from the remaining portion. By this display, therefore, it is possible to easily and correctly grasp whether the cell number of the raised letters is in excess of the maximum embossed cell number (i.e., the maximum continuous embossing amount), or how much the cell number of the raised letters is in excess of the maximum embossed cell number, thereby providing enhanced operability.

Preferably, the maximum continuous embossing amount is defined as the maximum number of embossed dots that can be continuously embossed, and the determination means includes embossed dot number acquisition means for acquiring, from the raised letters under editing, the embossed dot number thereof, and embossed dot number excess determination means for determining whether the acquired embossed dot number is in excess of the maximum embossed dot number.

According to this arrangement, it is determined whether the embossed dot number of raised letters is in excess of the maximum embossed dot number, and then excess cell images corresponding to the portion exceeding the maximum embossed dot number and/or a corresponding excess notation character string is displayed distinguishably from the remaining portion. By this display, therefore, it is possible to easily and correctly grasp whether the embossed dot number of the raised letters is in excess of the maximum embossed dot number (i.e., the maximum continuous embossing amount), or how much the embossed dot number of the raised letters is in excess of the maximum embossed dot number, thereby providing enhanced operability.

Preferably, the maximum continuous embossing amount is defined as the maximum embossing time during which continuous embossing can be performed, and the determination means comprises embossing time calculation means for calculating, from the raised letters under editing, the embossing time during which they are embossed, and embossing time excess determination means for determining whether the calculated embossing time is in excess of the maximum embossing time.

According to this arrangement, after the embossing time of raised letters has been calculated, it is determined whether the calculated embossing time is in excess of the maximum embossing time, and then excess cell images corresponding to the portion exceeding the maximum embossing time and/or a corresponding excess notation character string is displayed distinguishably from the remaining portion. By this display, therefore, it is possible to easily and correctly grasp whether the calculated embossing time is in excess of the maximum embossing time (i.e., the maximum continuous embossing amount), or how much the calculated time of embossing raised letters is in excess of the maximum embossing time, thereby providing enhanced operability.

Preferably, the processing sheet has a fixed length, and the maximum continuous embossing amount is the maximum arranged cell number determined based on the fixed length.

According to this arrangement, the embossing of raised letters is performed with respect to a sheet having a fixed length, such as a standard-sized processing sheet. But unlike in the case of characters, the size of raised-letter cell and the distance between raised-letter cells cannot be adjusted. Such being the case, the maximum arranged cell number in accordance with the fixed length is predetermined, and thereby excess cell images corresponding to the portion exceeding the maximum arranged cell number and/or a corresponding excess notation character strings is displayed distinguishably from the remaining portion. By this display, therefore, it is possible to easily and correctly grasp whether the arranged cell number is in excess of the maximum arranged cell number, or how much the arranged cell number is in excess of the maximum arranged cell number, thereby providing high operability.

Preferably, the apparatus further comprises arrangement length setting means for setting the arrangement length when arranging the raised letters under editing on the processing sheet, and the maximum continuous embossing amount is the maximum arranged cell number determined based on the set arrangement length.

According to this arrangement, since an arrangement length for arranging raised letters on the processing sheet is set (the "arrangement length" here cited corresponds to the definite length in the so-called "definite length setting" in the ink character printing), the size of raised-letter cell and the distance between raised-letter cells cannot be adjusted unlike in the case of ink characters. This being the case, the maximum arranged cell number in accordance with the range length is predetermined, and thereby excess cell images corresponding to the portion exceeding the maximum arranged cell number and/or a corresponding excess notation character strings is displayed distinguishably from the remaining portion. By this display, therefore, it is possible to easily and correctly grasp whether the arranged cell number is in excess of the maximum arranged cell number, or how much the arranged cell number is in excess of the maximum arranged cell number, thereby providing enhanced operability.

According to another aspect of this invention, there is provided a program which executes the above-described raised-letter information processing method, or causes to function the above-described raised-letter information processing apparatus according to this invention. Also, a storage medium according to this invention stores the above-described program so as to be readable by an apparatus capable of program-processing.

According to this arrangement, this invention allows the above-described raised-letter information processing apparatus to function, or can execute the above-described raised-letter information processing method. Therefore, by processing the program by the apparatus capable of program-processing or executing the program after having been read from the storage medium, it is possible to perform the editing of raised-letter information with consideration given to the restriction on the maximum continuous embossing amount under embossing, which provides enhanced operability.

DESCRIPTION OF THE PREFERRED EMBODIMENTS

Hereinafter, a description will be made about a label producing apparatus (raised-letter information processing apparatus) according to the embodiments of this invention with reference to the accompanying drawings.

First Embodiment

Figure 1:
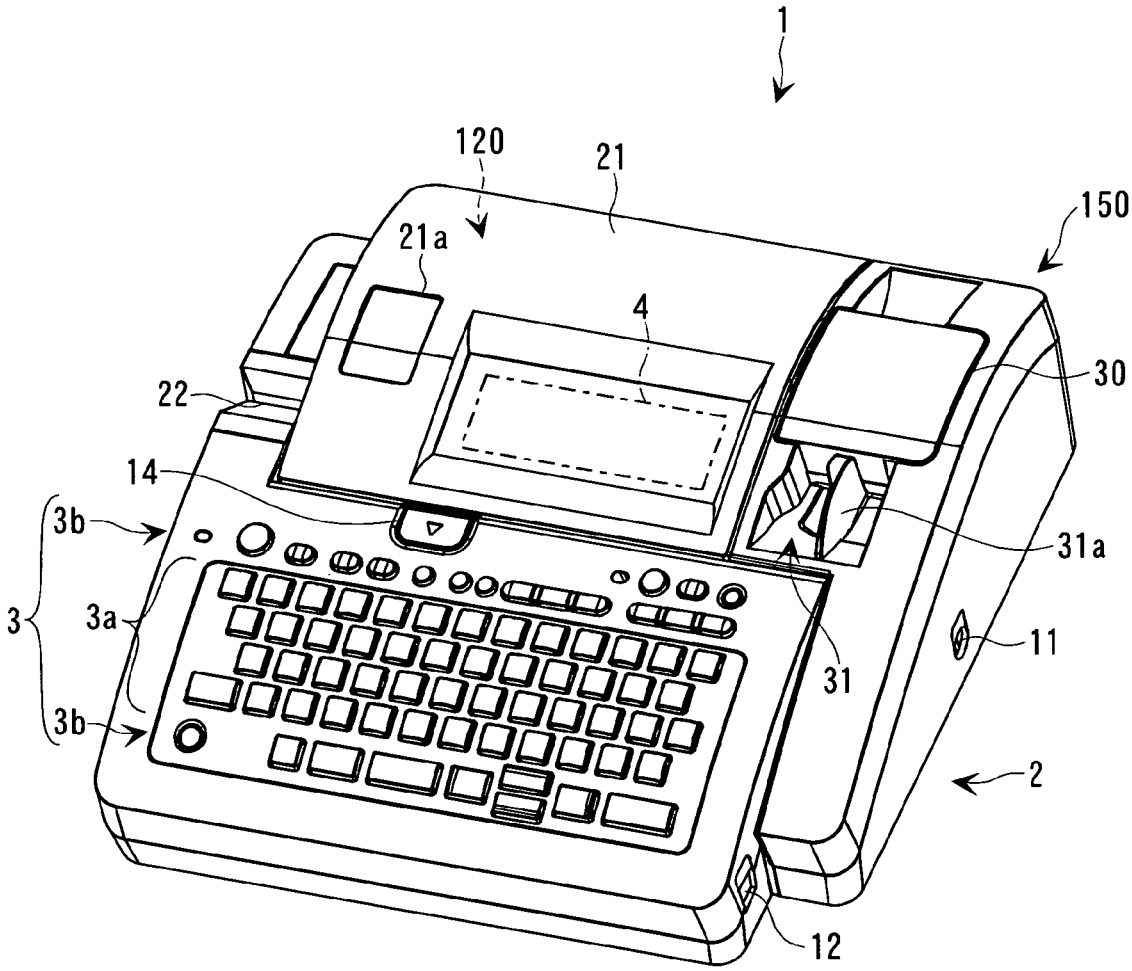
FIG. 1 is an external perspective view of a label producing apparatus according to this invention.
Figure 2:
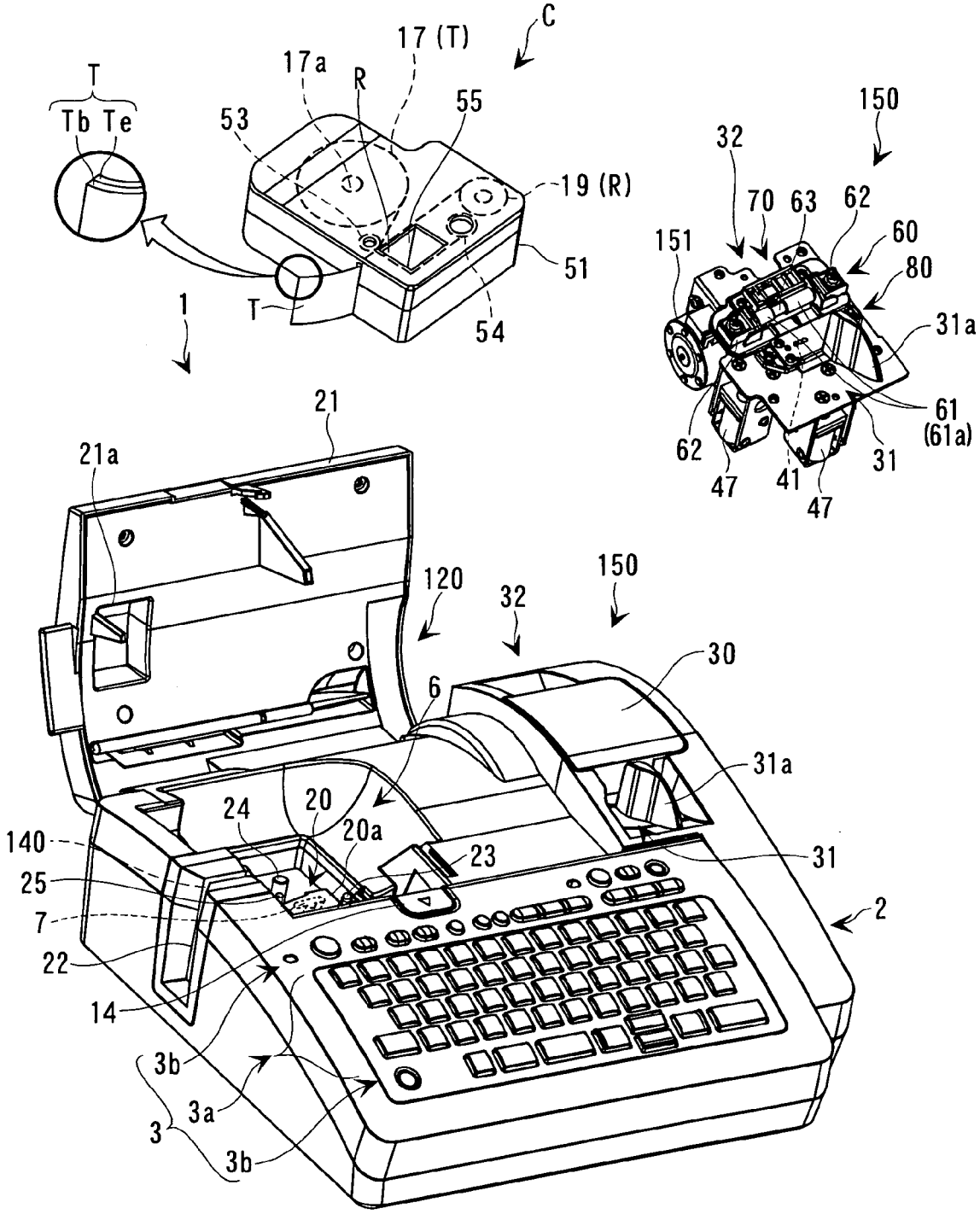
FIG. 2 is an external perspective view of the label producing apparatus in FIG. 1, with its lid opened.

As shown in FIGS. 1 and 2, the label producing apparatus 1 has an outer hull constituted by an apparatus case 2. A keyboard 3 with various input keys is arranged on the front top surface of the apparatus case 2, while an opening/closing lid 21 is mounted to the rear top surface of the apparatus case 2. On the surface side of the opening/closing lid 21, there is provided a rectangular display 4.

Inside the opening/closing lid 21, there is incorporated an ink character printing section 120 that performs ink character printing (printing of characters such as letters, codes, etc.) with respect to a tape T paid out of a tape cartridge C, and a cartridge mounting section 6 for mounting the cartridge C is formed in a recessed manner. In response to the depression of a lid-opening button 14, the tape cartridge C is removably mounted to the cartridge mounting section 6 with the opening/closing lid 21 opened. The opening/closing lid 21 has a sight glass 21*a* for visually recognizing the mounted/non-mounted state of the tape cartridge C, with the opening/closing lid 21 closed.

On the right side of the opening/closing lid 21 (i.e., the latter-half portion on the right side of the apparatus case 2), an assembly for performing raised-letter embossing (a raised-letter embossing section 150; shown in the upper right portion in FIG. 2) is incorporated inside the opening/closing lid 21. On the top surface this assembly, there is provided an embossing section cover 30 so as to cover the raised-letter embossing section 150. On this side (as seen in the figure) of the embossing section cover 30, an embossed tape insertion opening 31 through which a tape (processing sheet) T is manually inserted by a user, is formed in a recessed manner. On the rear side of embossing section cover 30, an embossed tape discharge opening 32 through which the tape T after having being embossed is discharged, is formed in a recessed manner so as to provide a downward slope along a tape running path (feed path) 70. Also, in the vicinity of the embossed tape insertion opening 31, there is provided a manual feed guide capable of adjusting the width in the tape width direction.

The raised-letter embossing section 150 includes an embossing unit 80 that performs embossing by three embossing pins (embossing heads) 41 (see FIG. 5B), a tape feed unit (tape feed mechanism) 60 that feeds tape T inserted into the embossed tape insertion opening 31 to the embossed tape discharge opening 32, and the tape running path 70 on which the tape is conveyed. This embossing assembly is formed by incorporating these units into a frame constituting the tape running path 70, and integrally mounted to the apparatus case 2. Raised letters B are formed by selectively driving the three embossing pins 41 by the embossing unit 80 with respect to a tape T being delivered by the driving force of the tape feed unit 60 along the tape running path 70.

At the center of the right side portion of the apparatus case 2, there are provided a power supply opening 11 for power supply, and a connection opening (interface) 12 for establishing the connection with an external apparatus (not illustrated), such as a personal computer (see FIG. 1). On the left side portion of the apparatus case 2, there is provided a print tape discharge opening 22 that communicates the cartridge mounting section 6 and the outside with each other. Also, a cutting section 140 for cutting the tape T delivered from the ink character printing section 120 is arranged to face the above-described print tape discharge opening 22. When the rear end of the tape T is cut off by the cutting section 140, the tape T after having been subjected to ink character printing is discharged through the print tape discharge opening 22.

Figure 3:
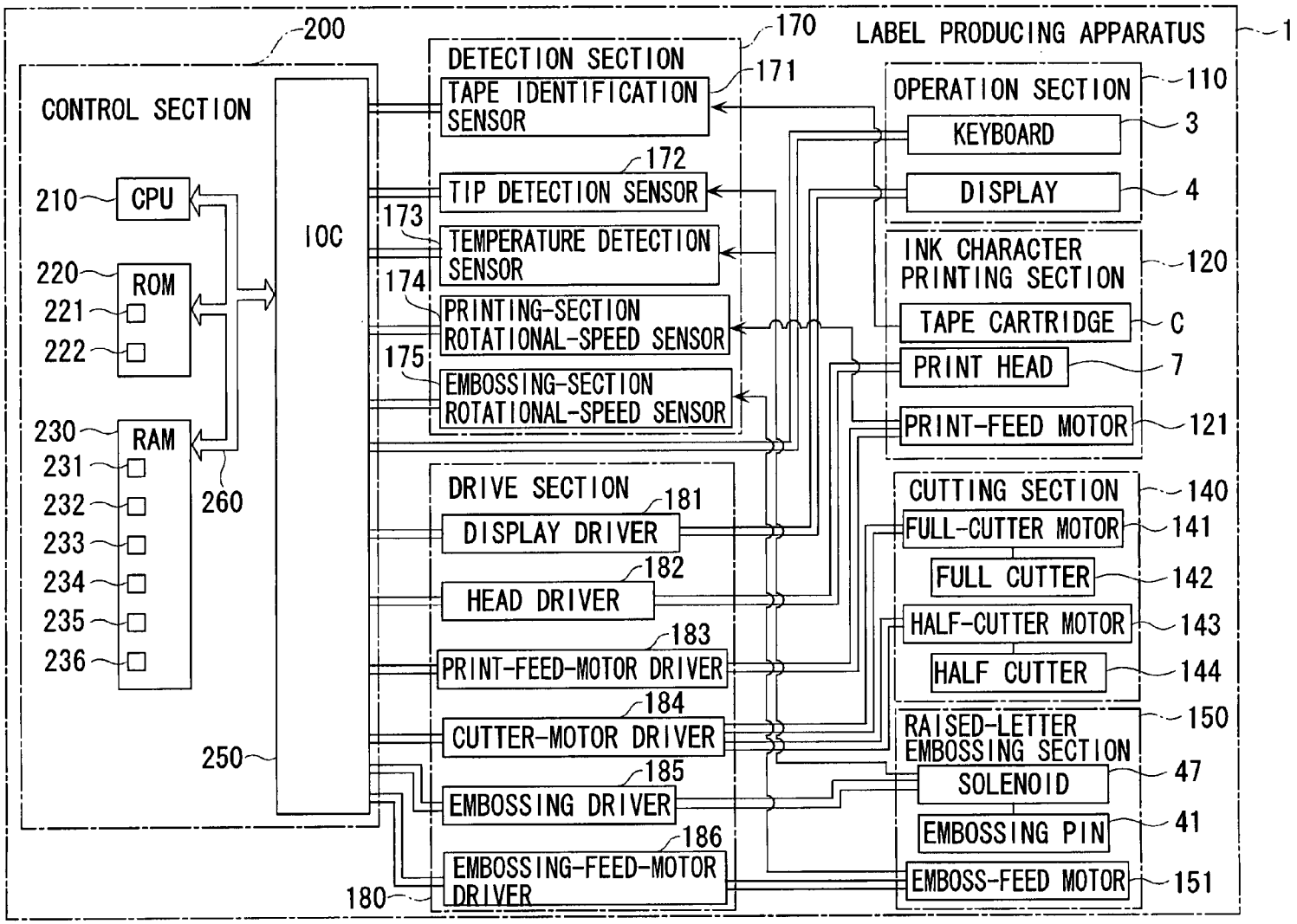
FIG. 3 is a schematic block diagram of a control system of the label producing apparatus in FIG. 1.

As shown in FIG. 3, the label producing apparatus 1, as a basic construction viewed from control system, comprises: an operation section 110 including a keyboard 3 and a display 4, and controlling the input of character information and the display of various pieces of information; an ink character printing section 120 including a tape cartridge C, a print head 7, and a print-feed motor 121, and performing ink character printing on the tape T while conveying or feeding the tape T and an ink ribbon R; and the cutting section 140 including a full cutter 142 and a half cutter 144, and a full-cutter motor 141 and a half-cutter motor 143 that drive the full cutter 142 and the half cutter 144, respectively, and that cut off the tape T having been subjected to printing.

Furthermore, the label producing apparatus 1 has: a raised-letter embossing section 150 that includes solenoids 47, embossing pins 41, and an emboss-feed motor 151, and that performs raised-letter embossing on the tape T while conveying the tape T; and a detection section 170 that performs various detecting operations, and that includes a tape identification sensor 171 for detecting the kind of the tape T (tape cartridge C), a tip detection sensor for detecting the tip of the tape T in the raised-letter embossing section 150, for example, a transmission type tip detection sensor 172, a temperature detection sensor 173 for detecting the ambient temperature (environmental temperature) in the raised-letter embossing section 150, printing-section rotational-speed sensor 174 for detecting the rotational speed of the print-feed motor 121, and an embossing-section rotational-speed sensor 175 for detecting the rotational speed of the emboss-feed motor 151.

Moreover, the label producing apparatus 1 comprises: a drive section 180 that includes a display driver 181, a head driver 182, a print-feed-motor driver 183, a cutter-motor driver 184, an embossing driver 185, and an embossing-feed-motor driver 186, and that drives each of these portions; and a control section 200 that is connected with each of these portions and controls the entirety of the label producing apparatus 1.

The control section 200 includes a central processing unit (CPU) 210, read-only memory (ROM) 220, random-access memory (RAM) 230, and an input output controller (hereinafter, IOC) 250, which are interconnected with one another through an inner bus 260. The ROM 220 includes: a control program block 221 that stores control programs for controlling various processing, such as ink character printing processing and raised-letter embossing processing, by the CPU 210; and a control data block 222 that stores character font data for performing ink character printing, and raised-letter font data for performing raised-letter embossing, as well as control data for performing embossing control with respect to raised-letter data, and so forth.

The RAM 230 is used for work areas for control processing, and includes, beside various work area blocks 231: an ink character data block 232 storing created ink character data; a raised-letter data block 233 storing created raised-letter data; a display data block 234 storing display data for displaying on the display 4; a layout block 235 for storing layouts of set ink character printing area (printing arrangement section) Ep and raised-letter embossing area (embossing arrangement section) Eb; and inverted raised-letter data block 236 storing inverted raised-letter data B' (see FIGS. 9A and 9B), which is used when raised-letter data is to be embossed in a state of having been rotated 180 degrees in accordance with a set layout. Here, the RAM 230 is backed up at all times so as to retain stored data even upon power-down.

Incorporated in the IOC 250 are logic circuits for complementing the function of the CPU 210 and treating interface signals, the logic circuits being constituted of a gate array, a custom LSI (large-scale integrated circuit), and the like. As a result, the IOC 250 takes input data and control data from the keyboard 3 or values of various sensors into the inner bus 260, as they are or with some processing applied. Also, the IOC 250, operatively associated with the CPU 210, outputs, to the drive section 180, data and control signals outputted from the CPU 210 to the inner bus 260, as they are or with some processing applied.

With these features, the CPU 210 inputs various signals/data from each portion of the label producing apparatus 1 through the IOC 250 in accordance with control programs in the ROM 220 as well as processes various data in the RAM 230 based on the various inputted signals/data, and then outputs the various signals/data to each of the portions of the label producing apparatus 1 through the IOC 250, thereby performing control of ink character printing processing, raised-letter embossing processing, and the like.

Figure 9A:
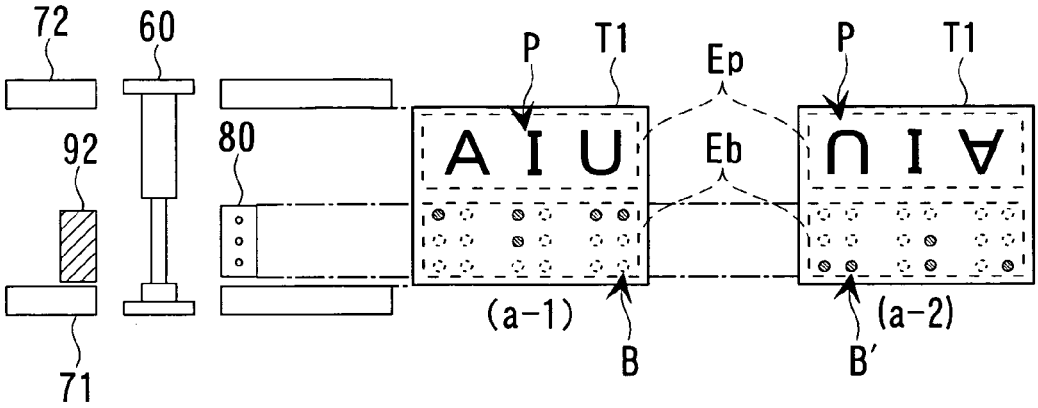
FIGS. 9A to 9C are diagrams explaining the difference in the tape width in FIG. 7.
Figure 9B:
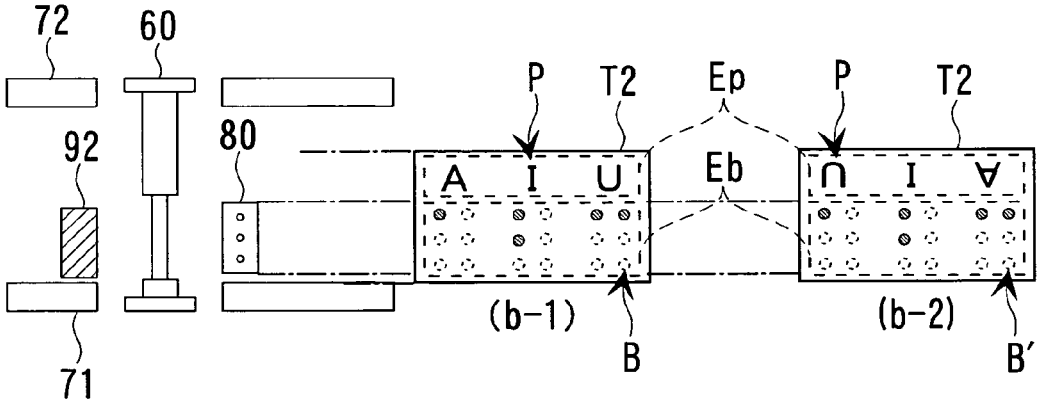

For example, once character information has been inputted from the keyboard 3, the CPU 210 creates ink character data P and raised letter data B in response to this information, and makes an adjustment to the length or the like between both data as required, as well as prepares for inverted raised-letter data B' (see FIGS. 9A and 9B). Also, the CPU 210 stores ink character data P (including margin data) before and after the adjustment in the ink character data block 232. Likewise, the CPU 210 stores raised-letter data B (including margin data) before and after the adjustment in the raised-letter data block 233, and stores the inverted raised-letter data B' in the inverted raised-letter data block 236.

Upon acquisition of an instruction for ink character printing and raised-letter embossing from the keyboard 3, the CPU 210 starts to drive the print-feed motor 121, and drives the print head 7 in accordance with the detection result by the printing-section rotational-speed sensor 174, to thereby perform ink character printing based on the ink character data P. Thereafter, based on the ink character data (already adjusted as required), the CPU 210 feeds a predetermined length of tape, and after having cut off the rear end of the tape T by the full cutter 142, discharges the tape T through the print tape discharge opening 22.

Following the foregoing operations (without reset operation and power-down operation), when the tape T cut into a strip shape is inserted into the tape insertion opening 31 by a manual insertion by the user, the CPU 210 performs raised-letter embossing based on the raised-letter data B of the inverted raised-letter data B' by driving the embossing unit 80 and the tape feed unit 60 (see FIGS. 1 to 3). After having completed the embossing, the CPU 210 feeds a predetermined length of tape that has already adjusted based on the raised-letter data B and the like by driving the emboss-feed motor 151, and then discharges the tape T through the print tape discharge opening 32 (see FIGS. 1 to 3).

Raised letters B (six-dot raised letters) formed on the tape T will now be described with reference to FIGS. 4A and 4B.

Figure 4A:
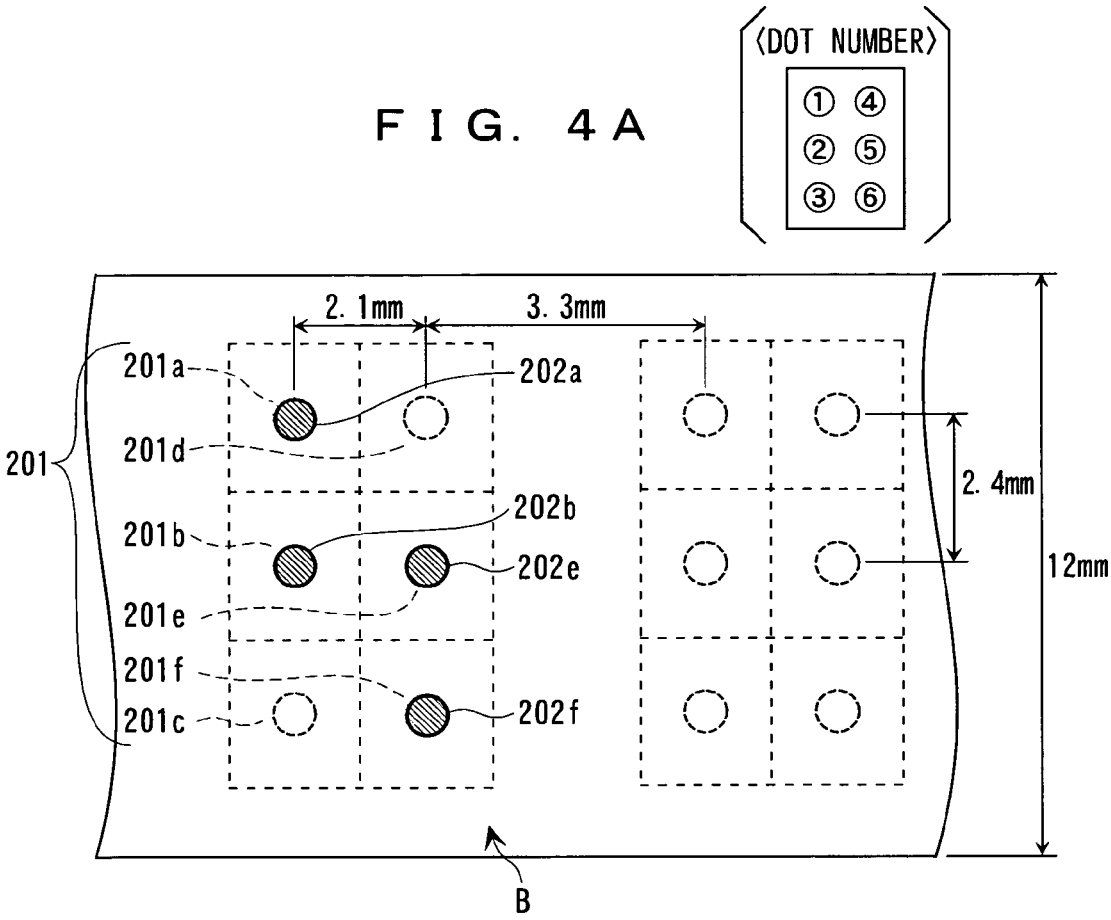
FIG. 4A is a diagram showing a six-dot raised letter.
Figure 4B:
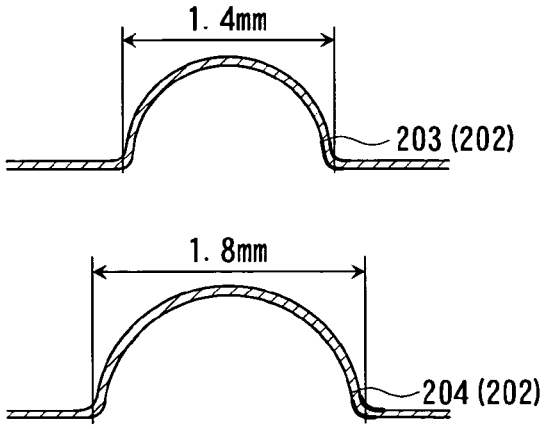
FIG. 4B is a diagram showing cross sections of embossed portions.

According to the specifications (commercially available specification or "private specifications") of one character (one cell) and the distance between characters (between cells) commonly used in raised-letter devices, raised-letter typewriters, and the like, as shown in FIG. 4, in the six-dot raised letters B, six dots (embossed dots referred to as a "first dot" to a "sixth dot"; shown in the upper right part in FIG. 4) comprise three columns of dots and two rows of dots constitute one cell 201. This one cell 201 represents one character, a voiced sound code, and other attributes by a pattern consisted of embossed dots and non-embossed dots out of the six dots. For example, FIG. 4A, where the first, second, fifth, and sixth dots are embossed dots, and the third and fourth dots are non-embossed dots, indicates raised letters (raised-letter data) B representing character information "shi" (kana such as hiragana or katakana, i.e., Japanese syllabic).

For raised letters B, beside six-dot raised-letters representing such kana characters (including katakana and hiragana), numerals, and the like, eight-dot raised letter representing kanji characters (raised letter in which one cell is constituted of four columns of dots and two rows of dots) is also used. In this first embodiment, the six-dot raised letter B is exemplified, but this invention can be also incorporated into the label producing apparatus 1 forming the eight-dot raised letter.

In the six-dot raised letter B, one cell has an arrangement pattern constituted of three columns of dots and two rows of dots, and is divided into six embossed dots 201*a* to 201*f*. The longitudinal pitch in a cell is about 2.4 mm, the lateral pitch therein is about 2.1 mm, and the pitch between cells is about 3.3 mm. In FIG. 4, out of six embossed dots 201*a* to 201*f*, four embossed dots 201*a*, 201*b*, 201*e*, and 201*f* are selectively embossed to represent "si" (kana), and four embossing convex portions 202*a*, 202*b*, 202*e*, and 202*f* each having a sectional shape such as a cylindrical, semispherical, conical, or quadrangular pyramid shape (see FIG. 4B) with corners rounded off, are formed on the tape T. Here, in order to emboss the six-dot raised letters, it is judged that the tape width (tape T3) requires at least 12 mm, from the size (length in the width direction of the Tape) of one cell 201.

Also, in the label producing apparatus 1, two kinds of mutually exchangeable units are prepared in advance as the embossing units 80. One has small embossed convex portions 203 with a smaller size (diameter: about 1.4 mm), and the other has large embossed convex portions 204 with a larger size (diameter: about 1.8 mm). These two kinds of embossed convex portions 203 and 204 are selected to suit usage. For example, the small embossed convex portions 203 are intended for a person who is accustomed to reading out raised letter B (congenital sightless persons), while the large embossed convex portions 204 are intended for a beginner (adventitious sightless person).

With reference to FIGS. 1 to 3, a description will be made about raised letters B (six-dot raised letters B) formed on the tape T. In the keyboard 3, there are provided a character key group 3*a* and a function key group 3*b* for designating various operation modes. The character key group 3*a* is for inputting character information for performing ink character printing and raised-letter embossing, and has a full key configuration based on JIS (Japanese Industrial Standards) keyboard layout. The function key group 3*b*, similar to common word processor and the like, includes a conversion key for kanji (Chinese character) conversion and the like, a cancel key for canceling processing and the like, a cursor key for cursor movement, a determination (Enter) key for the determination of an alternative in various selection screens and for a line feed at the time of text inputting, and so forth.

The function key group 3*b* further includes: print/execution key (print key) for executing ink character printing or raised-letter embossing, a feed start key for instructing for the start of feed of the tape T in the raised-letter embossing section 150, and an embossing start key for perform raised-letter embossing, as well as a mode key for selecting a processing mode for ink character printing or raised-letter embossing, a layout key for setting an arrangement of the ink character printing area (printing arrangement section) Ep and the raised-letter embossing area (embossing arrangement section) Eb, a preview key for performing a preview display of the arrangement result prior to the execution of the printing operation and the like, a scroll key for performing a scroll display thereof, a raised-letter input key for inputting/editing raised-letter information, and a raised-letter translation key that, when converting an ordinary character string such as ink characters and the like into raised letters (i.e., when translating ordinary characters into raised letters, or when reading raised-letter cells, creating an intermediary character string (raised-letter translation character string), and so forth.

Figure 8A:
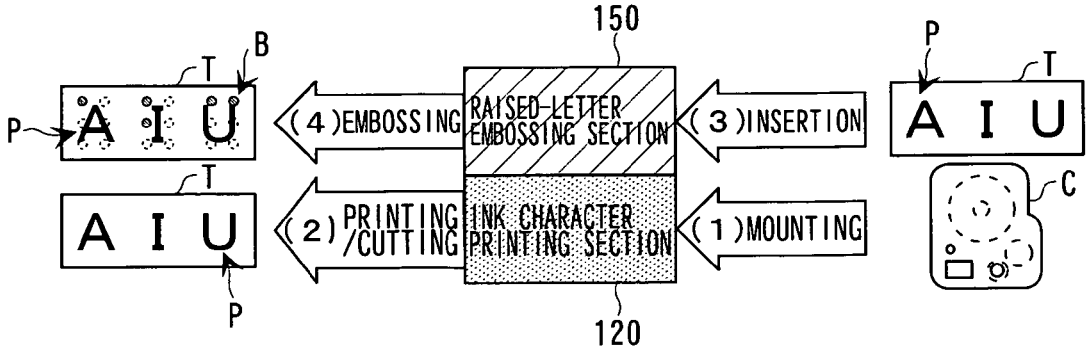
FIGS. 8A to 8C are diagrams explaining processing modes in FIG. 7.
Figure 8B:
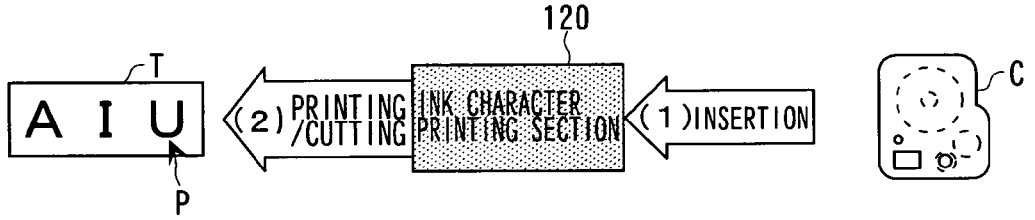
Figure 8C:
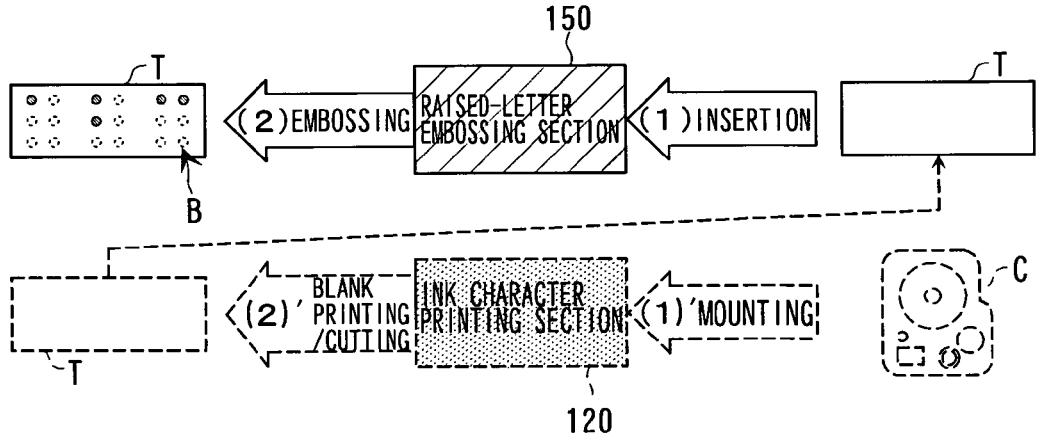

The processing modes selected by the mode key include: a first mode in which ink character printing and raised-letter embossing are performed based on inputted character information (see FIG. 8A), a second mode in which only ink character printing is performed based on inputted character information (see FIG. 8B), and a third mode in which only raised-letter embossing is performed based on inputted character information (see FIG. 8C). Out of these three modes, any one is selected as a processing mode.

The display 4 has a rectangular shape with a lateral (X) direction size of about 12 cm and a longitudinal (Y) direction size of about 5 cm, and can display inside it display images of 192 dots×80 dots. The display 4 is used when the user inputs character information from the keyboard 3 to create/edit ink character data or raised-letter data.

In the ink character printing section 120, the cartridge mounting section 6 includes a head unit 20 in whose head cover 20*a* the print head 7 comprising a thermal head is incorporated, a platen drive shaft 25 confronting the print head 7, a take-up drive shaft 23 for winding the ink ribbon R, a positioning projection 24 for a tape reel 17. Also, on the underside of the cartridge mounting section 6, there is provided the print-feed motor 121 for rotating the platen drive shaft 25 and the take-up drive shaft 23.

The tape cartridge C is configured to contain the tape reel 17 and the ribbon reel 19 in the cartridge case 51 thereof. The tape T and the ink ribbon R are formed so as to have the same width. A through-hole 55 for being fitted over a head cover 20*a* is also formed. Also, there is provided a platen roller 53 that is rotationally driven in engagement with the platen drive shaft 25, in correspondence with the portion where the tape T and the ink ribbon R are superimposed over each other. The ink ribbon R unreeled from or paid out of the ribbon reel 19 is adapted to go around the head cover 20*a* and to be wound up around a ribbon take-up reel 54 disposed adjacently to the ribbon reel 19.

Once the tape cartridge C has been mounted to the cartridge mounting section 6, the through-hole 55 is fitted over the head cover 20*a*, the center hole 17*a* of the tape reel 17 is fitted over positioning projection 24, the platen roller is fitted over the platen drive shaft 25, and the center hole of the ribbon take-up reel 54 is fitted over the take-up drive shaft 23. Also, the print head 7 abuts against the platen roller 53 sandwiching the tape T and the ink ribbon R therebetween, thereby allowing ink character printing. The tape T after having been subjected to ink character printing is delivered to the print tape discharge opening 22.

The tape T comprises a base tape (base sheet: information formation layer) Tb having an adhesive-agent layer (adhesive layer) provided on the rear surface thereof, and a peel tape (peel sheet: peel layer) Te stuck on the base tape Tb so as to cover the adhesive-agent layer. The base tape Tb is constructed by laminating an image-receiving layer that has improved fixing performance of ink thermosensitively transferred from the ink ribbon R, a substrate layer composed of a polyethylene phthalate (PET) film constituting almost exclusively the base tape Tb, an adhesive-agent layer constituted of adhesive-agent. The peel tape Te is for protecting the adhesive-agent layer from the adhesion of dusts and the like until the base tape Tb is used as labels. The peel tape Te comprises high quality paper subjected to silicon processing (in this embodiment, high quality paper made of PET is used).

As the tapes T, a plurality of tapes different in the tape kinds such as the tape width, tape color, print ink color, and tape material, are prepared in advance. A plurality of holes (not illustrated) indicative of these tape kinds are provided on the rear surface of the cartridge case 51. In correspondence with the plurality of holes, a plurality of identification sensors (micro-switches) 171 for identifying these holes is provided in the cartridge mounting section 6. The detection of state of the identification sensor 171 allows the tape kind to be determined. In this embodiment, three types of tapes: a tape T1 having a tape width of 24 mm, a tape T2 with a tape width of 18 mm, and a tape T3 with a tape width of 12 mm are taken as examples (see FIG. 6).

In the cutting section 140, the full cutter 142 (not illustrated) is of a slide type having a cutting blade with an angular tooth capable of slide-cutting in up-and-down directions, and is adapted to cause the cutter blade (a cutter holder) to slide along the width direction of the tape T via a crank mechanism with the full-cutter motor 141 used as a drive source. In response to its sliding operation, the cutter blade cuts both of the base tape Tb and the peel tape Te of the tape T facing the cutter blade, that is, it fully cuts the Tape T.

The half cutter 144 has substantially the same shape as the full cutter 142, and similarly to the full cutter 142, is of a slide type having a cutting blade with an angular tooth capable of slide-cutting. The half cutter 144 is disposed upstream of the tape feed (on the side adjacent to the tape cartridge C), and is configured to be slidable along the width direction of the tape T via a crank mechanism with the full cutter motor 141 used as a drive source. In this case, the projection amount of the cutter blade, unlike the case of the full cutter 142, is adjusted to be a projection amount large enough to cut the base tape TB alone. In response to its sliding operation, the cutter blade cuts only the base tape Tb of the tape T facing the cutter blade, that is, it makes half-cutting with respect to the Tape T.

Figure 5A:
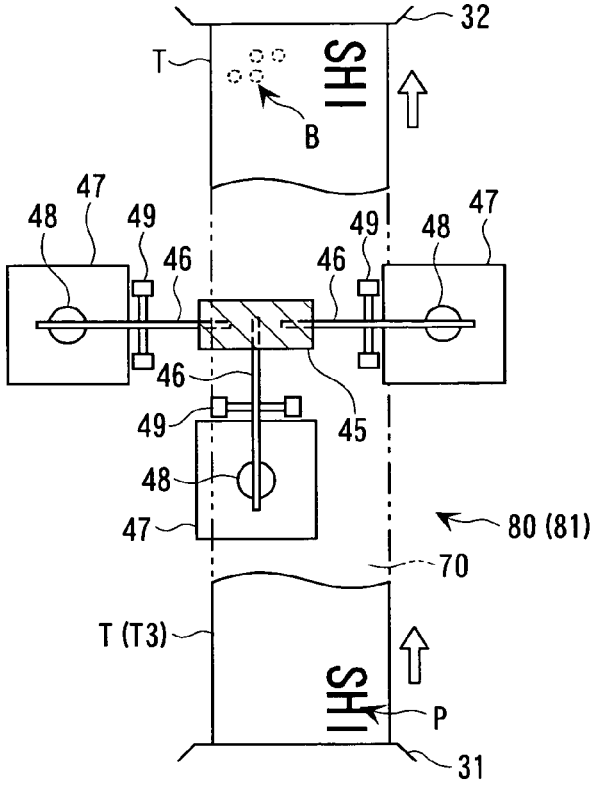
FIGS. 5A and 5B, respectively, are a plan view and sectional view of an embossing unit in the label producing apparatus.
Figure 5B:
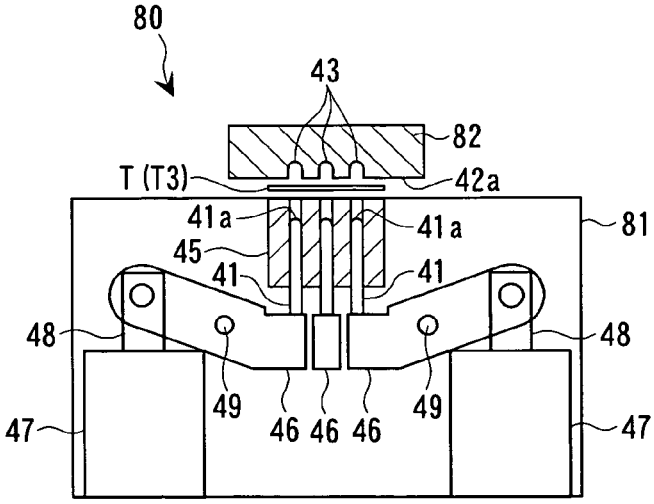

In the raised-letter embossing section 150, the embossing unit 80, as shown in FIGS. 5A and 5B, includes the embossing member (embossing head) 81 that is disposed on the rear surface side of the tape T and in which the three embossing pins 41 are assembled, and an embossing receiving member 82 receiving the thrust-up (embossing) of the embossing pins 41 at the position opposing the embossing member 81 with the tape T interposed therebetween, and it is fixedly arranged on the underside of the tape running path 70 (i.e., underside of the embossing unit 80 shown in FIG. 5B).

The embossing member 81 has the three embossing pins 41 arranged along the tape width direction (light-left directions in FIG. 5B) arranged at intervals of 2.4 mm, and corresponds to the three longitudinal embossed dots 201*a* to 201*c* (or 201*d* to 201*f*) out of the six embossed dots, as well as is held perpendicularly to the tape T by a guide member 45 guiding a linear motion and using solenoids 47 as drive sources. The head portion of the embossing pins 41 is formed so that the embossed convex portions 202 each have a sectional shape into a section shape such as a cylindrical, semispherical, conical, or quadrangular pyramid shape (see FIG. 4B), are formed on the tape T with corners rounded off.

In response to linear motion of plungers 48 by the respective solenoids 47, arm members 46 pivot about respective support member 49, and the embossing pins 41 each perform linear motion in the direction perpendicular to the tape T. The three solenoids 47 connected to the respective three arm members 46 are arranged so as to be located at corners of a triangle. On the other hand, the embossing receiving member 82 has, in its surface 42*a* opposite to the three embossing pins 41, embossing receiving concave sections 43 corresponding to the three embossing pins 41. The embossing pins 41 and the embossing receiving member 82 enable the embossed convex portion 202 to be formed on the tape T. Here, the surface 42*a* opposite to the three embossing pins 41 may be a flat surface formed of an elastic material, such as synthetic rubber, instead of the surface 42*a* having the embossing receiving concave sections 43.

Figure 6:
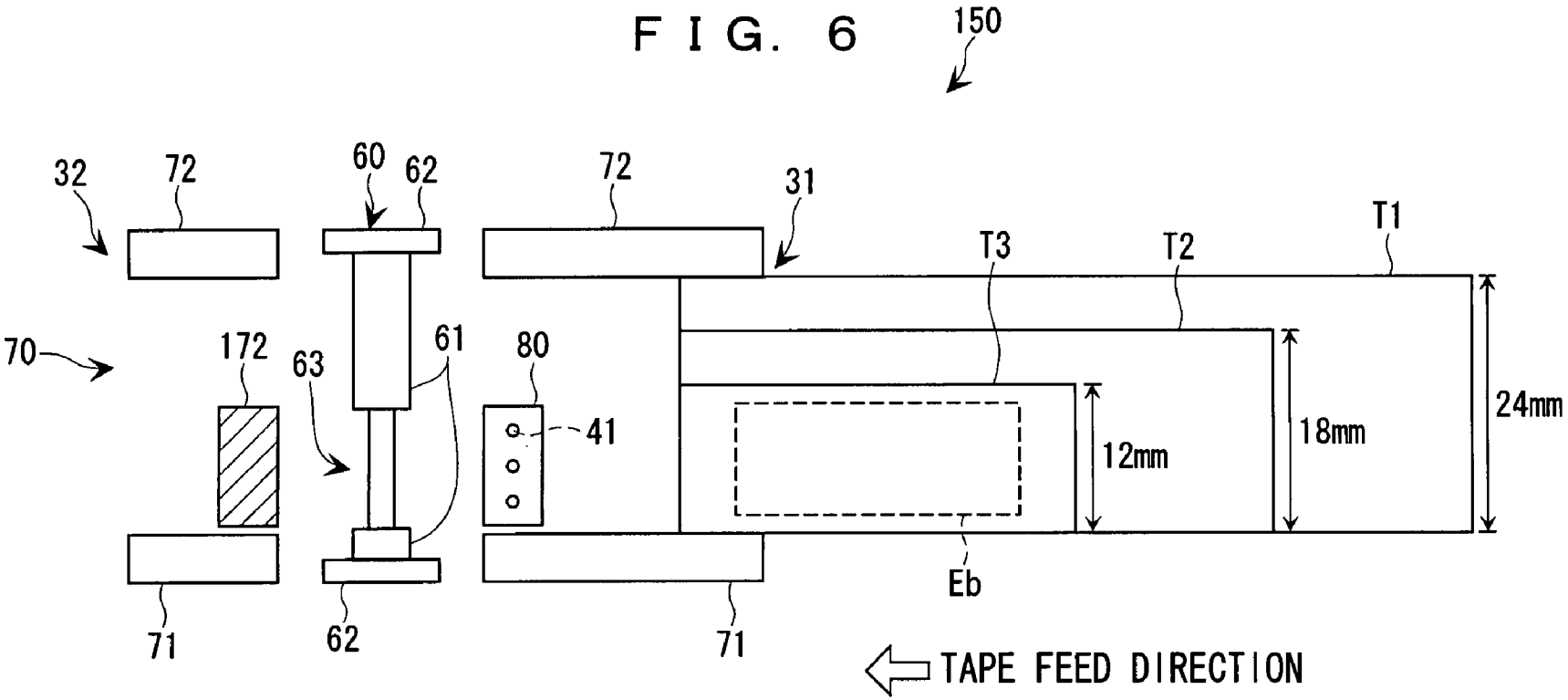
FIG. 6 is a diagram showing the feeding of a tape in a raised-letter embossing section in the label producing apparatus.

As shown in FIG. 6, the tape feed unit 60 includes a feed roller 61, a support member 62 for supporting it on the apparatus frame, and the emboss-feed motor 151 (see FIG. 3) rotating the feed roller 61 and capable of rotating in the forward and reverse directions. The feed roller 61 is a grip roller comprising a drive roller (not illustrated) and a driven roller 61*a* (not illustrated), and the driven roller 61*a* is provided with an annular groove 63 so as to avoid interference in order to prevent the formed raised letters B from being squashed.

The tapes T1, T2, and T3 in descending order of tape widths (i.e., they are 24, 18, and 12 mm in the tape width, respectively) can be inserted into the embossed tape insertion opening 31. The tape T1 with the maximum tape width is guided by upper and lower guides 72 and 71, and the other tapes T2 and T3 are guided by the lower guide 71 alone. Each of these tapes is manually inserted by the user until the tip thereof reaches the tape feed unit 60 (feed roller 61), namely, up to the position where the tape can be inserted. Then, the depression of a tape feed start key starts tape feed by the tape feed unit 60.

Raised-letter embossing processing is started by using, as a trigger, the detection of the tape tip by the tip detection sensor 172 (tape feed and raised-letter embossing based on inputted raised-letter data is started). Here, if the length from the tape tip to the embossing start position is set to be shorter than that between the embossing pins 41 and the tip detection sensor 172, the tape T is fed back by reversely rotating the feed roller 616, and embossing and tape feed in the forward direction is started when the tape T has been fed up to a proper position. Meanwhile, the start of embossing by the embossing unit 80 is performed not only by using the detection of the tape tip as a trigger, but also by a manual operation, i.e., by the user depressing the embossing start key on the keyboard 3.

Figure 7:
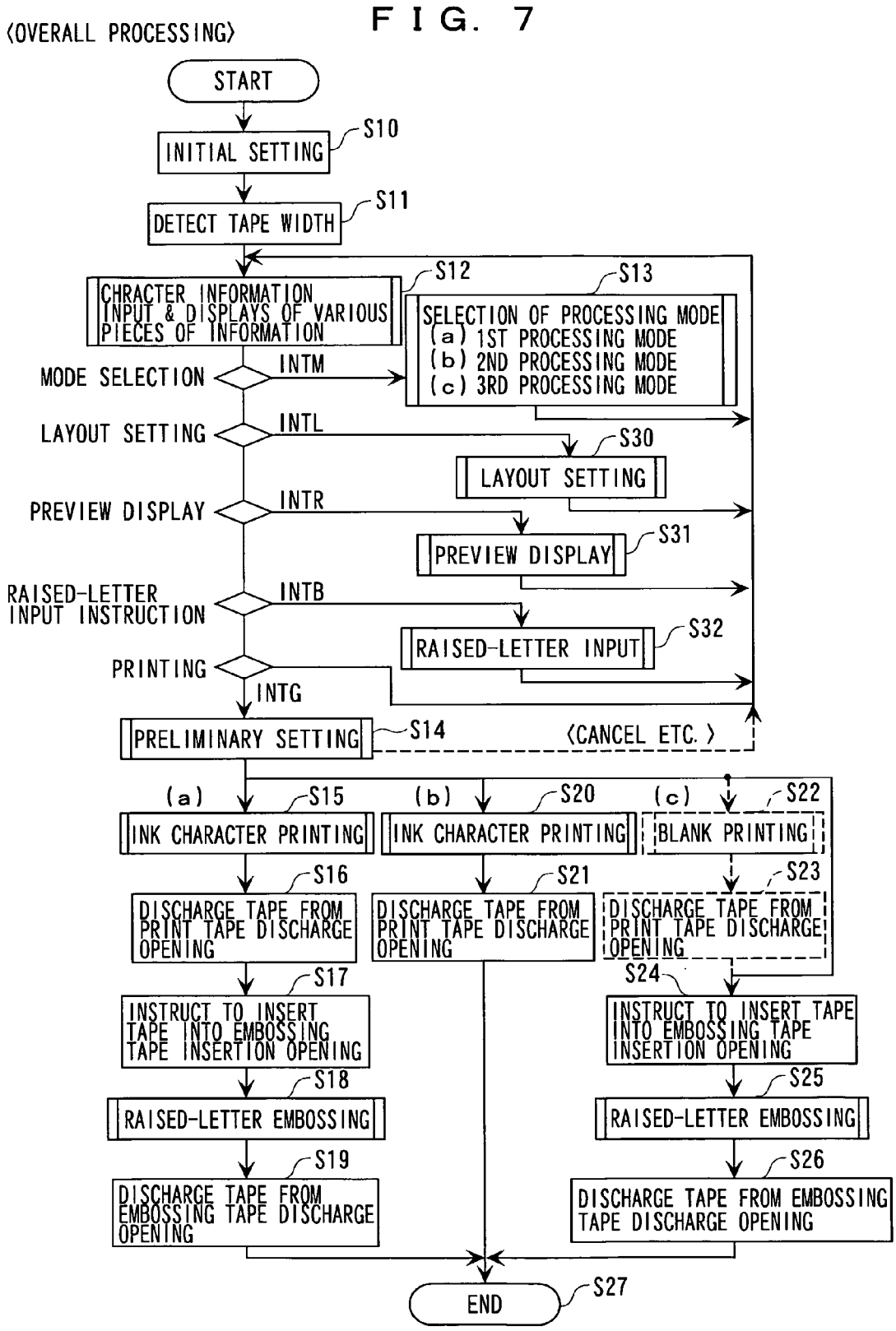
FIG. 7 is a flowchart showing the overall processing of the label producing apparatus.

Next, a description will be made about the overall processing of the label producing apparatus 1 with reference to FIGS. 7, 8, and 9A to 9C. As shown in FIG. 7, upon starting the processing by power-on (depression of power key), firstly an initial setting is performed such as the restoration of each control flag that has been retracted in order to return the status to that at the last power-down time (S10), and then the tape kind is detected by the tape identification sensor 171 shown in FIG. 3 (S11). Next, by data input from the keyboard 3 by the user (or data input from an external apparatus such as a personal computer), character information is inputted, and various information is displayed as editing screens or the like (S12).

Here, once a mode selection interruption (INTM) has occurred by a mode selection instruction (a mode key input) from the keyboard 3 (or by an instruction input from the external apparatus), the processing of processing mode selection is activated, and any one of a first processing mode (with ink characters and raised letters arranged side by side), a second processing mode (ink characters alone), and a third processing mode (raised letters alone) is selected (S13).

Also, once a layout setting interruption (INTL) has occurred by a layout setting instruction (a layout key input), or by an instruction input from the external apparatus, the processing of layout setting is activated (S30); once a preview display interruption (INTR) has occurred by a preview display instruction (a display key input), or by an instruction input from the external apparatus), the processing of preview display is activated (S31); once a raised-letter input instruction interruption (INTB) has occurred by a raised-letter input instruction (a raised-letter input key input), or by an instruction input from the external apparatus, the processing of raised-letter input is activated (S32); and once a print interruption (INTG) has occurred by a print/execution instruction (a print key input), or by an instruction input from the external apparatus, the processing of preliminary setting is activated (S32).

Here, in the preliminary setting (S14), when actual ink character printing or raised-letter embossing is to be performed, settings such as layouts and the like that are required at that point of time, and the final confirmation of each of the settings, are performed. If the print interruption (INTG) occurs without mode selection interruption, layout setting interruption, preview display interruption, and raised-letter input instruction interruption, the mode in the last-time setting is selected as a default (at the initial setting, the first processing mode; raised letters located at a lower stage; with ink characters and raised letters arranged side by side; or ink character input). Then, upon completing the preliminary setting (S14), actual ink character printing or raised-letter embossing is started.

Specifically, as shown in FIGS. 7 and 8A, in the case of the first processing mode (S13 (*a*)), after the printing of ink characters P has been performed by the ink character printing section 120 (S15), tape cutting and the discharge of the tape T from the print tape discharge opening 22 are performed S16), and. Here, this display of instruction may instead be performed by an indicator or a light-emitting diode (LED).

It is to be noted that, in FIG. 8A, alphabets "A", "I", "U" are transliteration of Japanese hiragana but that the raised letters given therein are those of hiragana, not of alphabets. The same applies to other figures of similar nature such as FIGS. 9A-9C, 10, 13, etc. where characters which are said to be written in hiragana, katakana or kanji are actually represented in alphabets. This is partly to avoid the usage of characters other than alphabets. In such cases, the raised letters correspond to hiragana, katakana or kanji whichever the case may be, and do not correspond to alphabets.

Once the tape T has been manually inserted into the embossed tape insertion opening 31 by the user, and after the embossing of raised letters B has been performed by the raised-letter embossing section 150 (S18), the embossed tape T is discharged through the embossed tape discharge opening 32 (S19), thereby completing the processing (S27).

In the case of the second processing mode (S13 (*b*)), ink character printing is performed by the ink character printing section 120 (S20), and then tape cutting/discharge is performed (S21), thereby completing the processing (S27). That is, in the second processing mode, as shown in FIG. 8B, the tape T paid out from the mounted tape cartridge C is fed to the ink character printing section 120 and thereby the ink characters P are printed.

Also, in the case of the third processing mode (S13 (*c*)), the instruction for tape insertion into the embossed tape insertion opening 31 is displayed on the display 4 (S24), and after raised-letter embossing has been performed by tape insertion by the user (S25), the embossed tape T is discharged through the embossed tape discharge opening 32 (S26), thereby completing the processing (S27). That is, in the third processing mode, as shown in FIG. 8C, the strip-shaped tape T (a tape cut to an arbitrary length) is fed to the raised-letter embossing section 150 by a manual insertion and thereby the raised letters B are embossed.

Also, in order to obtain strip-shaped tape T for manual insertion, as shown by dotted lines in FIGS. 7 and 8A, blank printing (tape feed alone without any printing operation) is performed (S22) instead of the ink character printing in the first processing mode prior to the tape insertion instruction (S24), and then tape cutting/discharge is performed (S23), whereby the discharged tape T that has been undergone the tape cutting may be used as the strip-at shaped tape T for manual insertion. Furthermore, while it is not illustrated in the figures, the specifications may be such that the tape cartridge C can be mounted upstream of the raised-letter embossing section 150 and that performs raised-letter embossing on a long length of tape paid out from the tape cartridge C. Moreover, the ink character printing and the raised-letter embossing may be performed based on mutually different information, instead of performing printing/embossing based on identical information.

Next, in the layout setting (S30), based on the detection result of the tape width (S11) and the result of the processing selection (S13), as main settings, the relative position between the ink character printing area (printing arrangement section) Ep and raised-letter embossing area (embossing arrangement section) Eb (see FIGS. 9A to 9C and the like) on the tape T, and the lengths of various arrangement sections (lengths of the printing arrangement section, embossing arrangement section, common arrangement section and the like outside the figures) are set, as well as settings similar to typical tape printing apparatuses, word-processors, including the setting of character size in the ink character printing.

In particular, in the case of the first processing mode (with ink characters and raised letters arranged side by side), as shown in FIG. 9A, when the detection result of tape width is 24 mm (tape T1), either one of a layout in which the printing arrangement section Ep is located at an upper stage and the embossing arrangement section Eb is located at an lower stage (a-1: hereinafter, "raised-letter lower stage"), and a layout in which the printing arrangement section Ep is located at a lower stage and the embossing arrangement section Eb is located at an upper stage (a-2: hereinafter, "raised-letter upper stage"), is selected.

Similarly, in the case of the tape width of 18 mm (tape T2), as shown in FIG. 9B, either one of raised-letter lower stage (b-1) and raised-letter upper stage (b-2) is to be selected. In this case, the length of the printing arrangement section Ep in the tape width direction becomes small in keeping with the tape width. Meanwhile, in these cases of T1 and T2, besides the layout in which ink characters and raised letters are arranged side by side (hereinafter, "ink characters and raised letters side-by-side arrangement"), a layout in which raised letters overlaps the ink characters that have been printed freely, e.g., in a larger size (hereinafter, "ink characters and raised letters overlapping") can also be selected for setting.

Figure 9C:
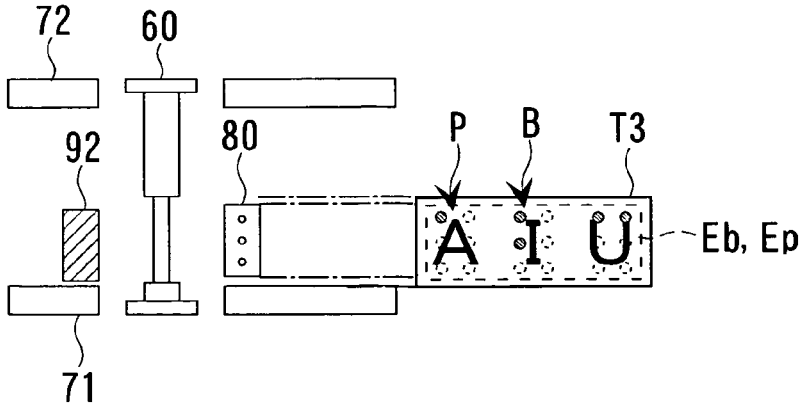

In the case of the tape width of 12 mm (tape T3), as shown in FIG. 9C, because the tape width has the minimum length that allows raised letters with the size (length in the tape width direction) of one cell 201 to be embossed (see FIG. 4A), a layout in which the printing arrangement section Ep and the embossing arrangement section Eb are superimposed over each other is exclusively available, irrespective of the settings of raised-letter upper/lower stage selection, ink characters and raised letters in side-by-side arrangement/overlapping selection.

In the label producing apparatus 1, besides common display screens such as text editing screens, corresponding preview display screens (preview screens and monitor screens) can be displayed within the display 4. Therefore, in the above-described preview display (S31 in FIG. 7), the image of ink character printing and/or raised-letter embossing at the point of time of performing actual ink character printing and/or raised-letter embossing is preview-displayed on a monitor screen within the display 4.

Next, more specific descriptions will be made about operational examples at the time of the label production, particularly of an example of inputting raised-letter information in accordance with raised-letter input information (depression of the raised-letter input key). Also, employing the following examples, explanations will be made on the "maximum (embossing or embossed) cell number", which is a restriction on the specifications established for function maintenance and safety securing in the label producing apparatus 1, as well as countermeasures thereagainst.

Figure 10:
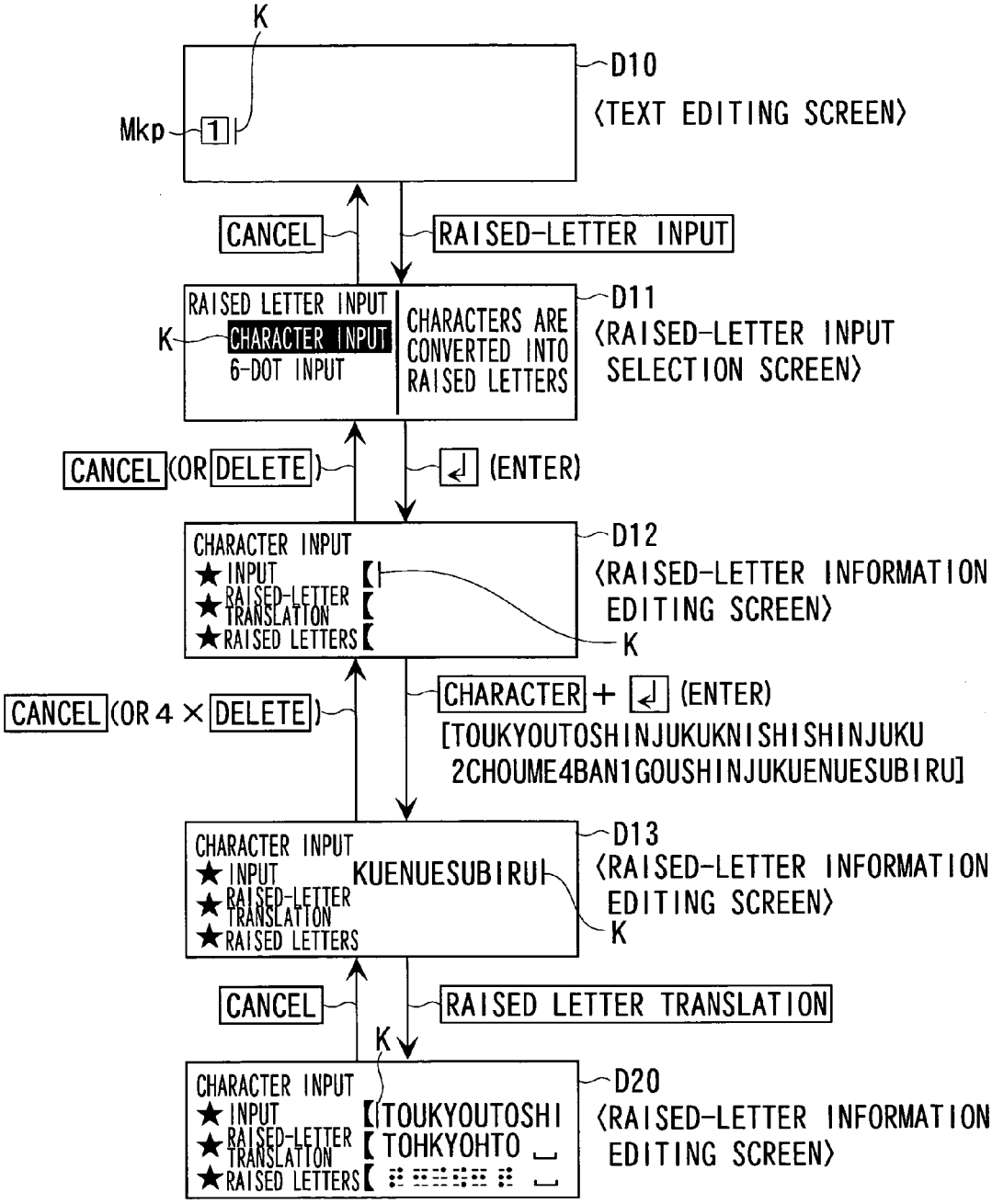
FIG. 10 is a diagram showing operations in inputting/editing of raised-letter information in a first example according to this invention.

For example, as shown in FIG. 10, in an initial state before text editing starts, the line number (print mark Mkp) of the first line from which editing starts is displayed, and a cursor K prompting the user to input the first character in the first line is displayed (text editing screen: D10; hereinafter, the state of the display screen of the display 4 is represented as Dxx, and explanation and illustration of the state is made using Dxx alone).

When, from this state (D10), raised-letter input keys have been depressed (raised-letter input instruction interruption (INTB) in FIG. 7), this state (D10) transitions to a selection screen (raised-letter input selection screen) in the first level of raised-letter input for inputting raised letters (D11). In the label producing apparatus 1, the user can cancel various instructions and input data and the like by depression of a delete key (deletion of one character per time) or by the depression of the cancel key, to thereby return the screen to the original state. Detailed descriptions of these are omitted as appropriate herein to avoid redundancy.

In the above-described state (D11), as an alternative, either one of a "character input" in which raised letters are inputted based on the character input, and a "six-dot input" in which raised letters (cells) are inputted in dot units by designating dots to be embossed, can be selected/designated by cursor operation (immediately after the screen transitioning, the alternative designated at last time is cursor-designated as a default and displayed; the initial setting is the "character input"). Likewise, in the following various screens, basically, immediately after the screen transitioning, the position designated at the last time is cursor-designated as a default and displayed. Detailed description of this is omitted as appropriate, and only the initial setting is described in addition.

Here, suppose that, from the above-described state (D11), "character input" is cursor-designated as it is, and selected (hereinafter, simply referred to as "selection determined") by the depression of the enter key, then the "character input" is set as a raised-letter input method (raised-letter input mode), and the screen is transitioned to a raised-letter information editing screen (D12).

In this raised-letter information editing screen, there are arranged in respective lines for displaying: an "input" field for the input/editing of an ordinary character string; a "raised-letter translation" field for the input/editing of a raised-letter translation character string (i.e., a field for inputting/editing the above-described inputted ordinary character string in a form suitable for translation or conversion into raised letters); and a "raised-letter" field for displaying the images of raised-letter cells corresponding to the raised-letter translation character string. In an initial state, the user is prompted, by the cursor K, to input the first character in the first line (D12).

Next, from this state (D12), for example, once an ordinary character string (ink character string; hiragana (Japanese syllabics) and the like): "tou-kyou-to-shi-n-ju-ku-ku-ni-shi-shi-n-ju-ku-2-chou-me-4-ban-1-gou-shi-n-ju-ku-e-nu-e-su-bi-ru" is inputted and determined after having passed through a non-determined state, the user is prompted, by the cursor K, to input a character subsequent to the last character (hiragana) "ru" (D13). Here, the non-determined state immediately after the character input (for example, a state of being displayed by black-white inversed characters or light characters) may be converted into kanji by the depression of the conversion key or the like and thereafter it may be determined, or, inputted (see FIG. 16; the details are given later).

Here, once the raised-letter translation key has been depressed from the above-described state (D13), the raised-letter translation character string translated from the above-described ink character string (katakana (Japanese syllabics) and the like): "toh-kyoh-to shi-n-ju-ku-ku ni-shi-shi-n-ju-ku 2-choh-me 4-ban 1-goh shi-n-ju-ku e-nu-e-su bi-ru" is displayed in the "raised-letter translation" field, and the images of the corresponding raised-letter cells is displayed in the "raised-letter" field. Then, in order to facilitate the ascertainment of the inputted ink character string, the cursor K is moved to the top of the ink character string, i.e., the front of the character (hiragana (Japanese syllabics)) "to" (in the "tou"), to thereby prompt the user to verify the ink character string (D20). Here, if the ink character string does not have a length (number of characters) as in this example but has only a length falling within one screen, the cursor may be arranged not to be moved from the tail, or may be arranged to be moved to the "raised-letter translation" field in order to show that the editing in the state of raised-letter translation character string is possible.

Now, the conversion into the raised-letter translation character string (raised-letter translation) is performed in conformance with customary specifications (private or commercially available specifications) used when performing raised-letter translation. Hence, for example, the "2-chou-me" in the "2-chou-me-4-ban-1-gou" (hiragana), and the like are converted into "2-choh-me" (katakana) and the like in conformance with a custom (specifications) such as "a prolonged sound code are used for "u"-euphony". Moreover, in conformance with the so-called "writing with a space between words", which is represented as segments by paragraphs or the like, blanks (blank cells, spaces) are inserted between the character string, and thereby the above-described phrase (hiragana) "2-chou-me-4-ban-1-gou" is converted into "2-choh-me 4-ban 1-goh" (katakana).

For this reason, the raised-letter translation character string tends to be a longer sentence than the ink character string as the origin of the raised-letter translation character string. Since the raised-letter translation character string is expressed by only kana (Japanese characters), if the ink character string includes kanji (Chinese characters), the tendency of the raised-letter translation character string to be lengthened (i.e., increased in the character number) by the raised-letter translation, becomes more significant.

The conversion from the above-described raised-letter translation character string into the raised-letter cell images is performed in accordance with the above-described private specifications as a matter of course. Hence, apart from a clear sound shown by one cell, so-called raised-letter codes (or control codes), such as an external character code, capital letter code, voiced sound symbol, semi-voiced sound code, and palatalized sound code are added, so that the cell number of raised letters becomes even larger than that of the raised-letter translation character string. For example, because the above-described raised letters "1-goh (katakana and the like) include an added numeral code and voiced sound code, they need five cells (for reference, see the note in the lower stage of D40 in FIG. 15)

In contrast, in the label producing apparatus 1, as the number of cells on which raised letters can be continuously embossed, a "maximum embossed cell number" (hereinafter, abbreviated as "maximum cell number")=50 has been predetermined.

As illustrated in FIG. 5 and the like, regarding the embossing member 81 of the embossing unit 80 in the label producing apparatus 1, the solenoids 47, as a drive source, actuate the plungers 48, arm members 46, and embossing pins 41, so that heating (Joule heat) caused by operation of the solenoids 47 themselves and frictional heat due to the plungers and the like, raise, as a whole, the ambient temperature during operation, although in a gradual manner. Under continuously operating conditions, such heating can raise the temperature of the apparatus frame 2, particularly of the vicinity of the raised-letter embossing section 150 including the embossing section cover 30 in the apparatus frame 2*m*, and therefore, in order to restrain the ambient temperature within a predetermined temperature, the maximum cell number has been predetermined as 50 from the viewpoint of safety.

In this case, for example, if the cell number of raised letters corresponding to a character string inputted by the user with an intention to convert it into raised letters, is in excess of 50, it is also possible to allow the embossing operation to be continued without change and automatically stop the embossing operation at the point of time when the number of embossed cells has attained 50 in compliance with the prescription for the maximum cell number (=50).

However, in this case, since it is necessary to notify the user of the stoppage of the embossing with a message, processing becomes complicated for the apparatus. On the other hand, for the user, even if he or she is acquainted with this notification, the need to reedit the raised-letter information at that point of time arises, thereby causing inconvenience. This is undesirable from the viewpoint of operability, as well as disadvantageous in wasting the tape T (resources).

As a solution, in the label producing apparatus 1, the display is devised to allow the user to easily grasp, during the editing of raised-letter information, i.e., before performing actual raised-letter embossing, that the cell numbers of raised letters under editing has exceeded the maximum cell number, without requiring time and effort for the user calculating cell number. Hereinafter, this feature will be described.

For example, in FIG. 10, once the raised-letter translation key has been depressed with the above-described ink character string inputted (D13), the raised-letter translation editing interruption occurs, and activates the raised-letter translation processing (S40).

Figure 11:
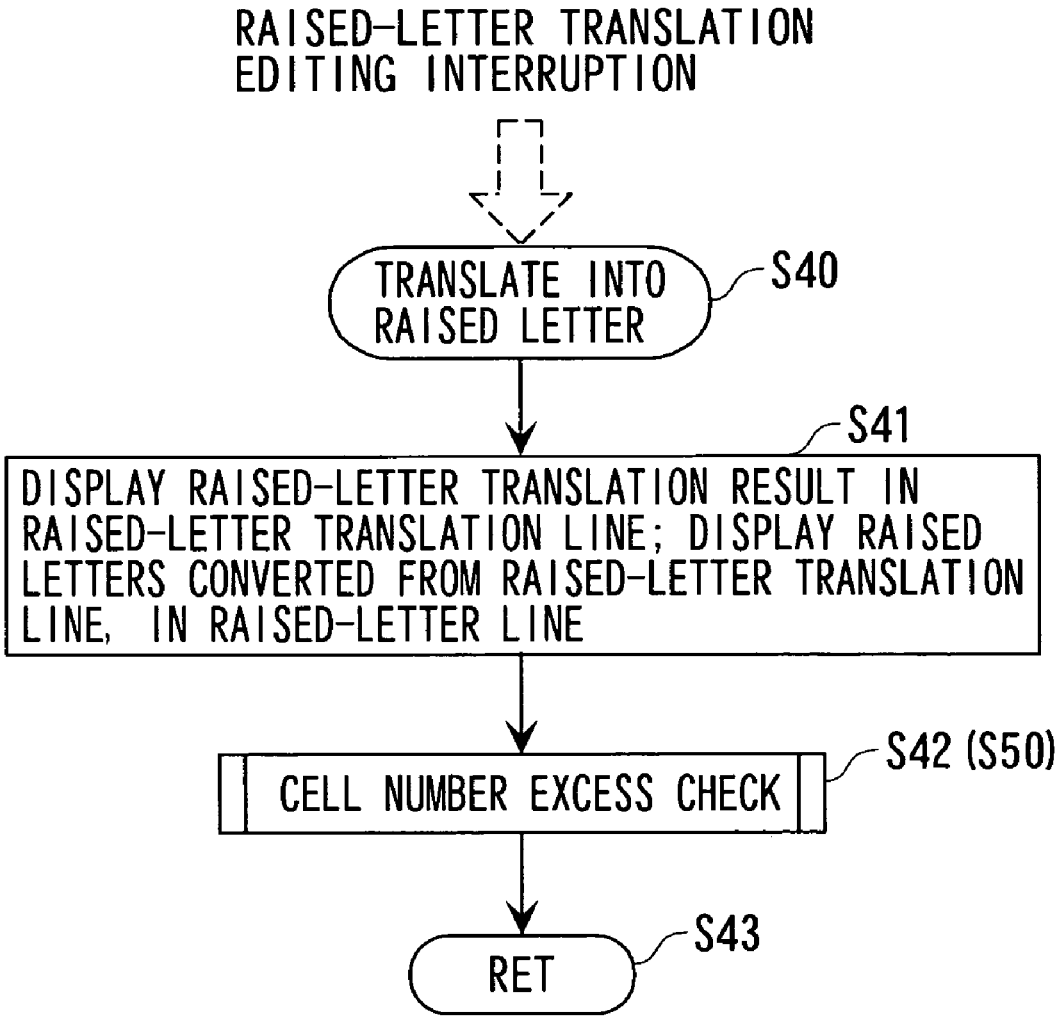
FIG. 11 is a flowchart of raised-letter translation processing according to this invention.

In this raised-letter translation processing (S40), as shown in FIG. 11, firstly the ink character string in an input line (i.e., a line in the "input" field) is translated into raised letters to thereby display the raised-letter translation result in the raised-letter translation line (i.e., a line in the "raised-letter translation" field), as a raised-letter translation character string, and then, the raised-letter translation character string is converted into raised letters to thereby display the conversion result in a raised-letter line (i.e., a line in the "raised-letter" field), as cell images (S41; see D20 in FIG. 10). Next, a check as to whether the cell number of raised letters is in excess of the maximum cell number, and a cell number excess check processing (S42) for displaying the result of above-described check are made, thereby completing the processing (S43).

The above-described raised-letter translation editing interruption occurs not only immediately after the raised-letter translation key has been depressed as described above, but also, each time editing (one character addition/delete etc.) is performed during the editing of a raised-letter translation character string, and hence, raised-letter translation processing is activated and executed each time. Also, the cell number excess check processing (S42) is, in actuality, treated as an interruption processing activated by a raised-letter editing interruption, and it occurs not only during the above-described raised-letter translation processing (S40), but also each time editing (one cell addition)/delete/modification (embossed dot addition/delete, or the like) is performed while directly editing raised letters (e.g., see FIG. 19), and hence, the cell number excess check processing (S42) is activated and executed each time. Therefore, in the above-described raised-letter translation processing (S40), in actuality, only the generation of a raised-letter editing interruption is performed (S42), thereby completing the processing (S43).

Figure 12:
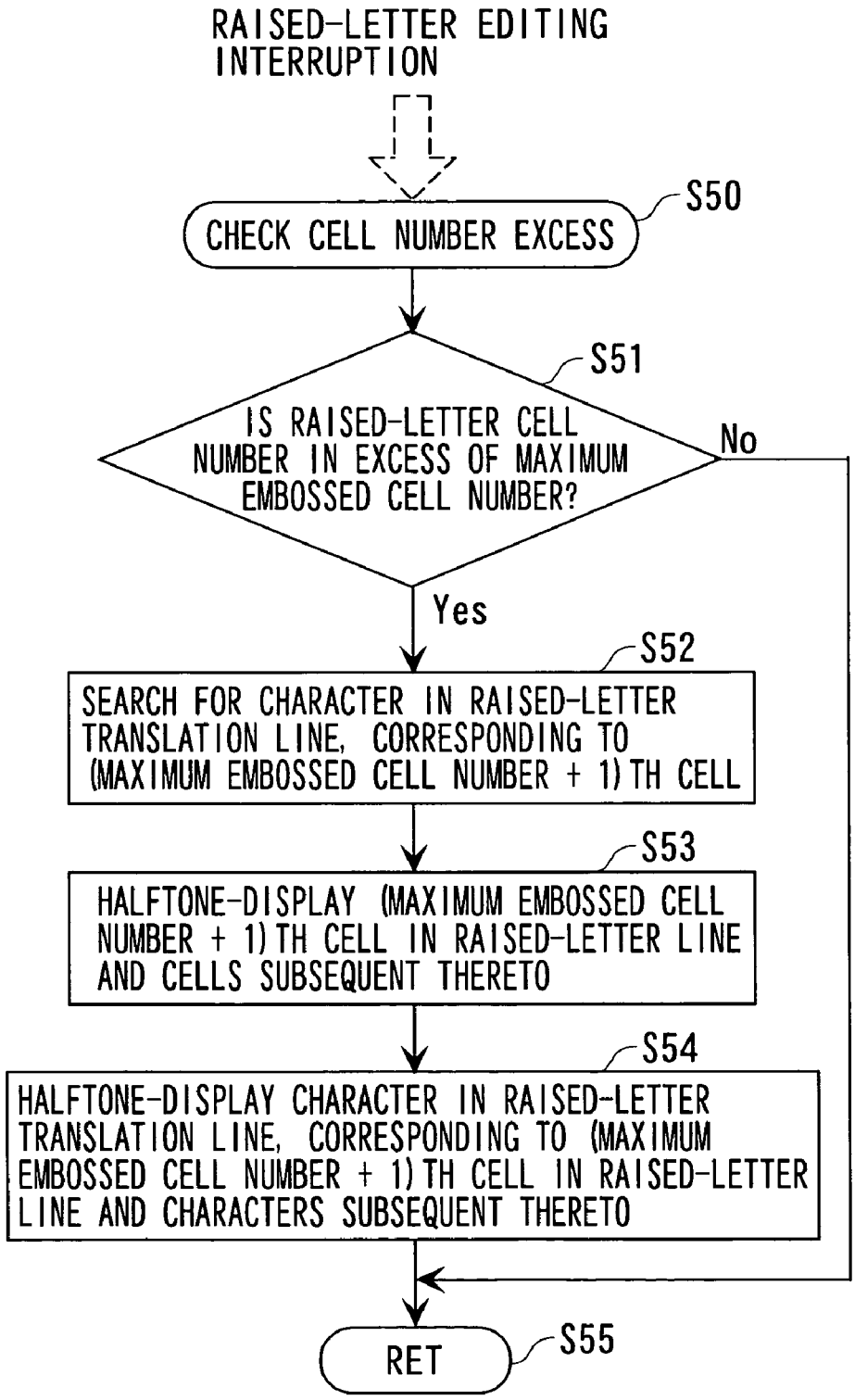
FIG. 12 is a flowchart of cell number excess check processing according to this invention.

Upon the occurrence of a raised-letter editing interruption, the cell number excess check processing (S50) shown in FIG. 12 is activated.

As shown in FIG. 12, in this cell number excess check processing (S50), firstly the cell number of raised letters under editing is checked, and determines whether the cell number is in excess of the maximum cell number (S51). If the cell number is not in excess of the maximum cell number (S51: No), the proceeding ends (S55).

On the other hand, if the cell number is in excess of the maximum cell number (S51: Yes), the character in a raised-letter translation line, corresponding to the (maximum embossed cell number+1)th cell, i.e., the (50+1=51)st cell is searched for (S52), and the images of the (maximum embossed cell number+1)th cell and the cells subsequent thereto in the raised-letter line are halftone-displayed (displayed in halftone style; S53). Then, the raised letter corresponding to the above-described 51st cell and the raised letters subsequent thereto in the raised-letter line are halftone-displayed (S54), thereby completing the processing (S55). That is, the portion corresponding to the (maximum embossed cell number+1)th cell, i.e., the 51st cell in the raised-letter translation line (a line in the "raised-letter translation" field) and the raised-letter line (a line in the "raised-letter" field) is halftone-displayed as an exceeded portion.

Figure 13:
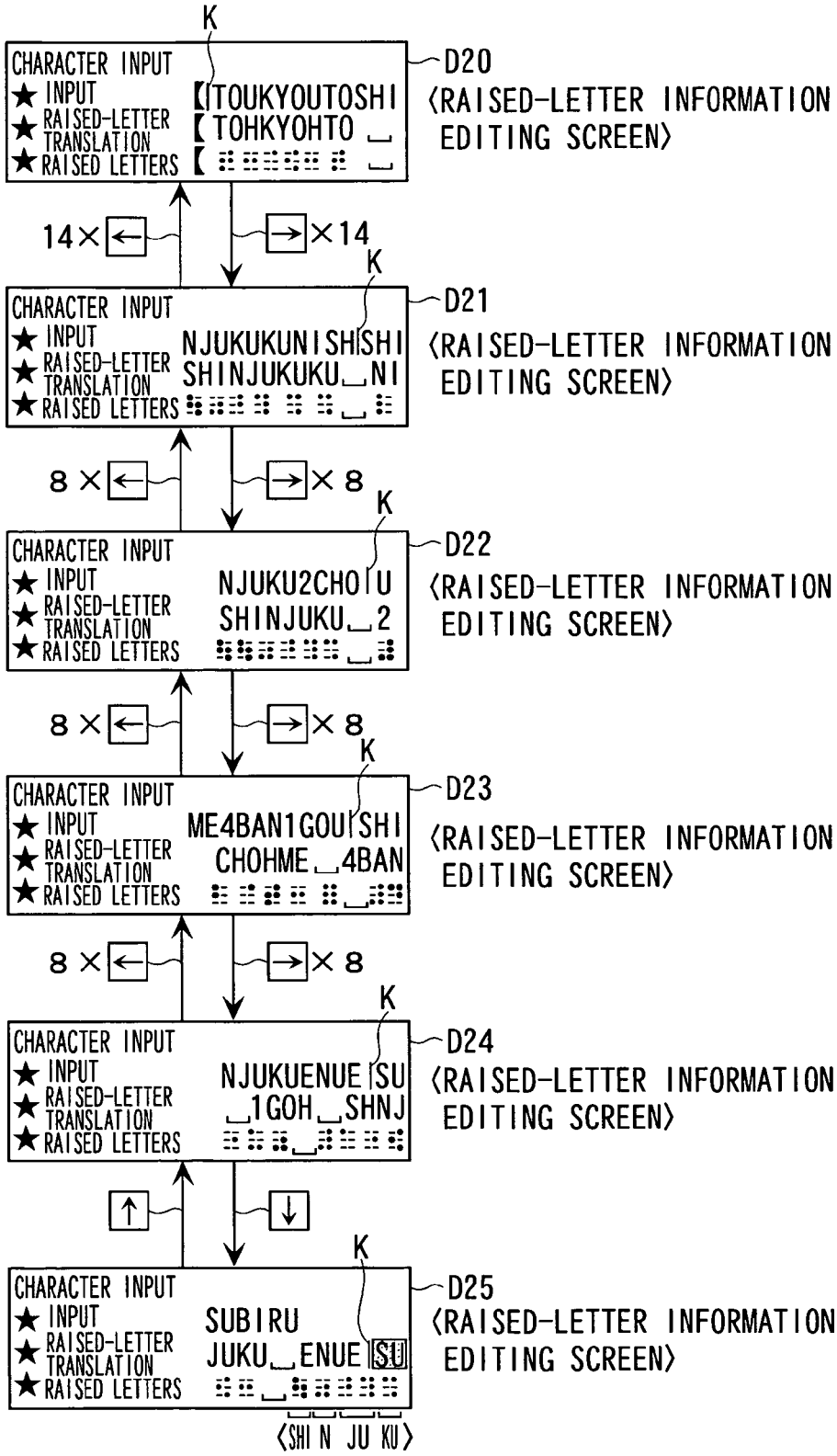
FIG. 13 is a diagram showing operations in inputting/editing raised-letter information in the first example (continued from FIG. 10)

As shown in FIG. 13, from the state where the top of an ink character string (a character string in the "input" field) is cursor-designated in the above-described raised-letter information editing screen (D20; common to FIG. 10), the display portion is scrolled by a cursor operation (D21 to D24), in order to verify the ink character string in the "input" field, raised-letter translation character string in the "raised-letter translation" field, and cell images in the "raised-letter" field. Because of the "writing with a space between words", the raised-letter translation character string should be longer (more in the number of characters) than the ink character string. Therefore, on the way (in FIG. 13, at the front of the "su" in the " . . . e-nu-e-su . . . " in the "input" field), when a cursor movement from the "input" field to the "raised-letter translation" field is performed, the cursor K assumes a state of being moved to a corresponding position (in FIG. 13, at the front of the "su" of the " . . . e-nu-e-su . . . ") in the "raised-letter translation" field (D25).

In the illustrated example, at the front of the "su" in the " . . . e-nu-e-su . . . (hiragana) in the "input" field, the cursor was moved from the "input" field to the "raised-letter translation" field, but the same state can be brought about also by moving the cursor to the "raised-letter translation" field before the above-described cursor movement, and further operating the cursor to move to the corresponding position (D25).

Figure 14:
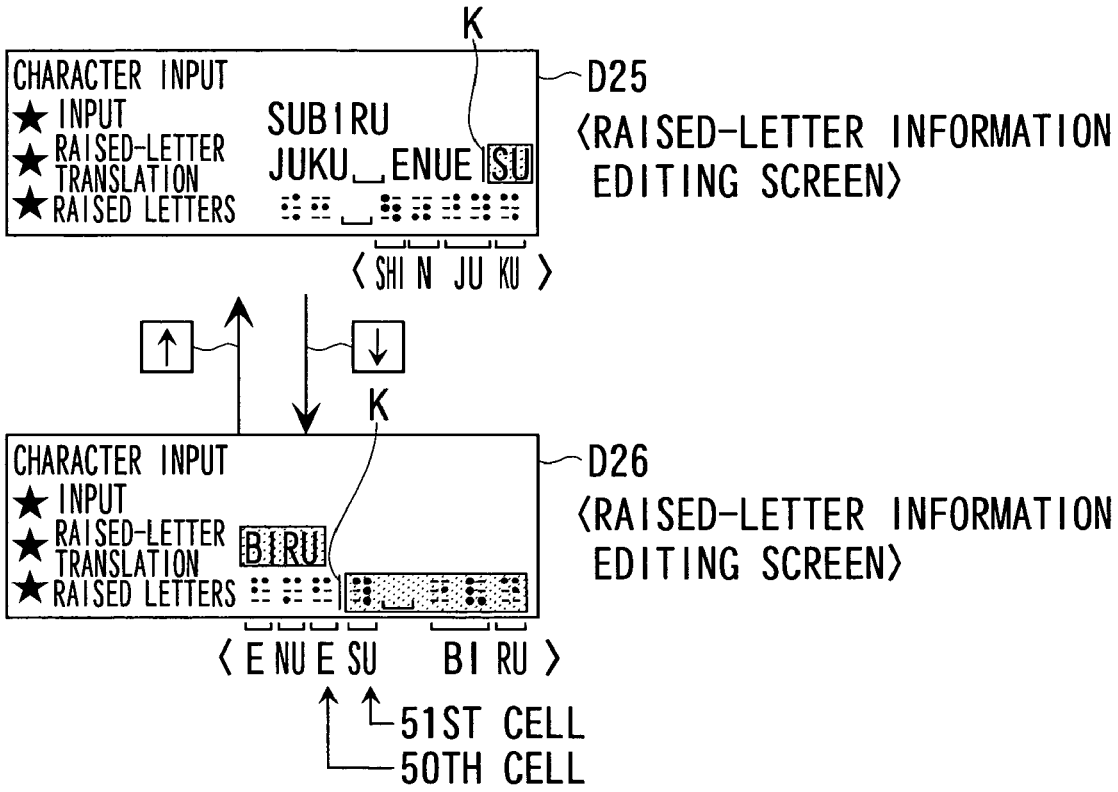
FIG. 14 is a diagram showing operations in inputting/editing raised-letter information in the first example (continued from FIG. 13)

Furthermore, as shown in FIG. 14, from this state (D25; common to FIG. 13), when the cursor is moved to the "raised-letter" field, the cursor K assumes a state of having been moved to the corresponding position in the "raised-letter" field (D26; the note in its lower stage in FIG. 14: "e-nu-e-su-bi-ru" (katakana) is the corresponding "raised-letter translation").

Here, the third cell in the "raised-letter" field in the screen D26 in FIG. 14, as noted in the lower stage of the D26, corresponds to the "e" in the "e-su" (katakana) in the "raised-letter translation" field, and simultaneously corresponds to the 50th (cell) image in the "raised-letter" field, i.e., the 50th cell. The cell corresponding to the next character "su" (katakana) corresponds to the 51st cell, i.e., the (maximum embossed cell number+1)th cell, and hence the cells subsequent thereto constitute an excess portion.

Such being the case, in this example, a character string portion (excess notation character string): "su-bi-ru" in the "e-nu-e-su-bi-ru" in the "raised-letter translation" string, and corresponding cell images (excess cell images) are halftone-displayed (see D25 and D26 in FIG. 14). This allows the user to grasp, during editing operation before actually performing embossing, that the raised letters are in excess of the maximum embossed cell number, how much the raised letters are in excess of it, and what are the raised-letter translation characters corresponding to the excess cells. This prevents useless operations and waste of the tape T. Also, grasping how much the raised letters is in excess of the maximum embossed cell number facilitates an editing operation.

With the above-described example to be referred to as a first example, in the first example, since the 50th and 51st cells were each an unvoiced sound (character expressible in one cell), the "raised-letter translation character string" was coped with as it was. However, in many raised letters, a single character thereof is expressed or represented by a plurality of cells, and therefore, the boundary between the portion within the maximum cell number and the portion exceeding it, i.e., the boundary between the 50th cell and the 51st cell does not necessarily correspond to the boundary between characters of corresponding raised-letter translation. Such a case will be now described, as a second example.

First, in this second example, the "e-nu-e-su" in the tail portion "e-nu-e-su-bi-ru" (hiragana) of the above-described first example is changed into "N-S" as capital letters of alphabets (external characters).

Figure 15:
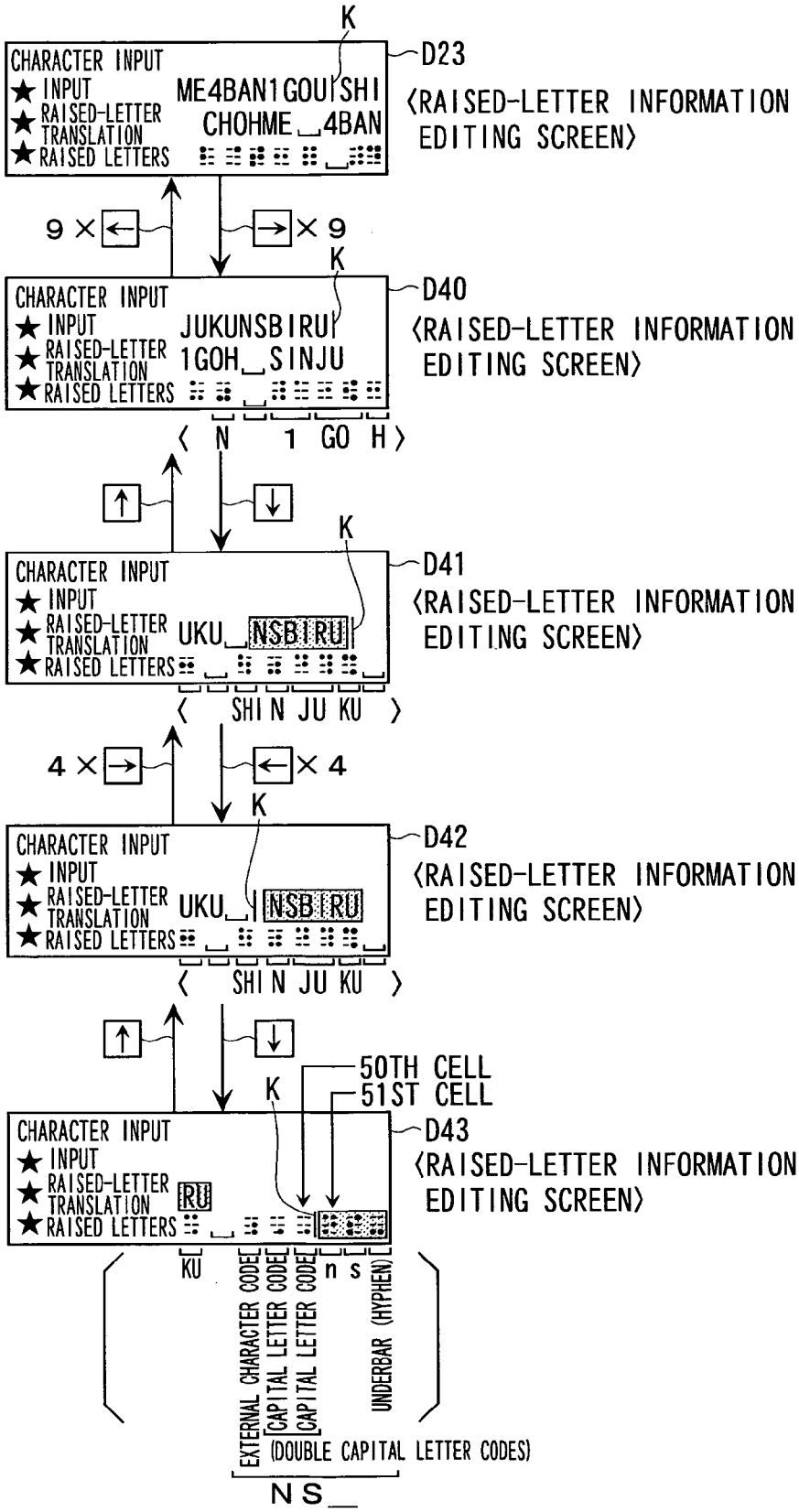
FIG. 15 is a diagram showing operations in inputting/editing raised-letter information in a second example according to this invention.

In this case, for example, as shown in FIG. 15, in raised-letter information editing screens as checking scenes similar to the foregoing, from the state where the cursor is located between the characters (hiragana) "u" and "shi" in the ink character string (hiragana and the like)" . . . "1-gou-shi-n-ju-ku-N-S-bi-ru" (D23; common to FIG. 13), the cursor is moved to the back of the last characters "ru" (hiragana) to go on with checking (D40). Upon movement of the cursor to the "raised-letter translation" field, the cursor assumes a state of have been moved to the back side of the "N-S-bi-ru" (katakana and the like), which is a corresponding position in the "raised-letter translation" field (D41).

However, since the "N-S-bi-ru" in the "raised-letter translation" field is an excess portion (halftone display portion), the user moves the cursor to the top thereof (D42), and then moves it to the "raised-letter" field to make a check (D43). Thereupon, it can be verified that the cell corresponding to the next "n" (alphabet) becomes the 51st cell because three cells of the 48th to 50th cells are control codes (i.e., an external character code and double capital letter codes), thereby constituting an excess portion (excess cell images).

Specifically, in this case, since two capital alphabets "N-S" continue, three control codes (one cell of external character code and two cells of double capital letter codes) are needed. Although the "N" could be expressed by cells up to the next one cell, the boundary between the excess portion and the other portion has been passed through at immediately before the "N". Hence, the "N" of a raised-letter translation character and the raised-letter translation characters subsequent thereto constitute an excess portion (excess raised-letter translation character string; excess notation character string).

Next, as a third example, an example in which the input is performed by using kanji, katakana, and the like, will be described below.

Figure 16:
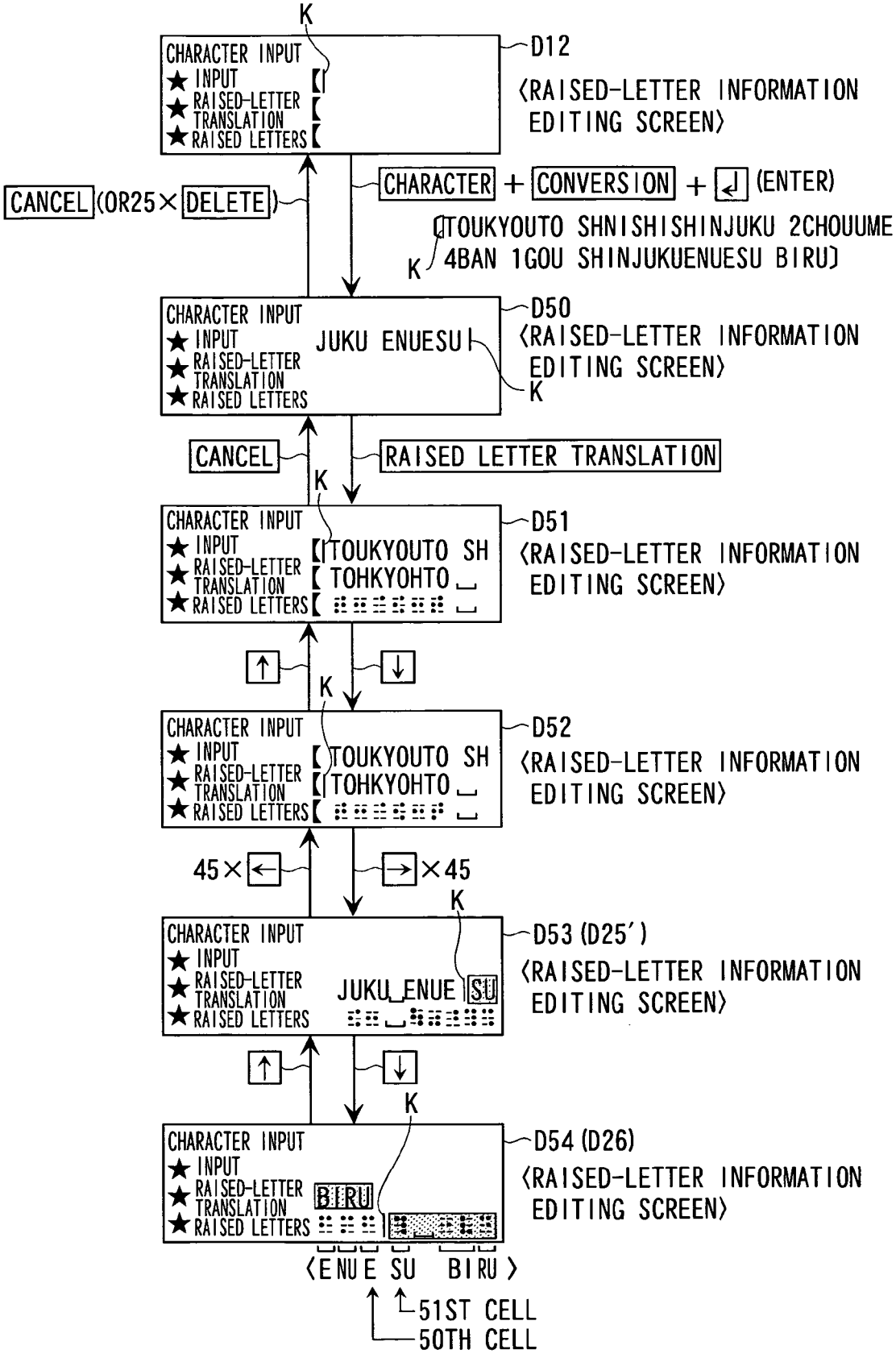
FIG. 16 is a diagram showing operations in inputting/editing raised-letter information in a third example according to this invention.

In this case, for example, as shown in FIG. 16, from the initial state of the above-described raised-letter information editing screen in FIG. 10 (D12; in common to FIG. 10), when the ink character string (hiragana and the like): "Tou-kyou-to-shi-n-ju-ku-ku-ni-shi-shi-n-ju-ku-2-cho-me-4-ban-1-gou-shi-n-ju-ku-e-nu-e-su-bi-ru" is inputted, it is entered as a non-determined state. Then, by the depression of the conversion key, this ink character string is converted into an ink character string with the kanji, katakana, and the like mingled: "Toukyou-to Shinjuku-ku Nishishinjuku 2-chome 4-1 Shinjuku NS biru (Bldg.)" and it is determined. Thereupon, the user is prompted to input a character subsequent to the last character (katakana) "ru" (D50).

It is to be noted that FIG. 16 shows the inputted result only in alphabets, not in kanji, or the like. This is partly to avoid the usage of characters other than alphabets, and partly because the representation in alphabets instead of in kanji may not be a hindrance to the understanding of this invention. The same applies to other figures such as FIGS. 17 and 18.

Here, supposing the raised-letter translation key is depressed from the above-described state (D50), since the raised-letter translation character string obtained by translating the above-described ink character string into raised letters is the same as that in the first example, the raised letters are the same as those in the first example, as well. Therefore, the raised-letter string (katakana and the like) "toh-kyoh-to shi-n-ju-ku-ku ni-shi-shi-n-ju-ku 2-choh-me 4-ban 1-goh shi-n-ju-ku e-nu-e-su bi-ru" is displayed in the "raised-letter translation" field, and the images of the corresponding raised-letter cells are displayed in the "raised-letter" field. Then, in order to facilitate the verification of the inputted ink character string, the cursor K is moved to the front of the top of the ink character string, i.e., the "tou" (kanji), to thereby prompt the user to verify the ink character string (D51).

In this third example, since the increase in the number of characters when converting the ink character string into the raised-letter translation character string is large as compared with the first example, the cursor is moved to the "raised-letter translation" field from the start (D52). With the display portion scrolled by cursor operation, when the cursor is moved while making a check of the ink character string in the "input" field, the raised-letter translation character string in the "raised-letter translation" field, (and the raised-letter string in the "raised-letter" field for a user who can understand raised letters), it is verified that the "su" in the tail "e-nu-e-su bi-ru" (katakana) in the raised-letter translation character string and the portion subsequent to the "su" is an excess portion (excess cell images), based on this portion being halftone-displayed (D53; substantially the same as D25 in FIG. 13 in the first example). Furthermore, for the verification of the "raised letters", when the cursor is moved to the "raised-letter" field, it can be verified that the cell images corresponding to the raised-letter translation characters "su" and the characters subsequent thereto are an excess portion, i.e., excess cell images (D54; the same as D26 in FIG. 14 in the first example).

Next, an example in which kanji conversion and the like are utilized instead of the above-described ink character string input in the second example, will be explained below as a fourth example.

Figure 17:
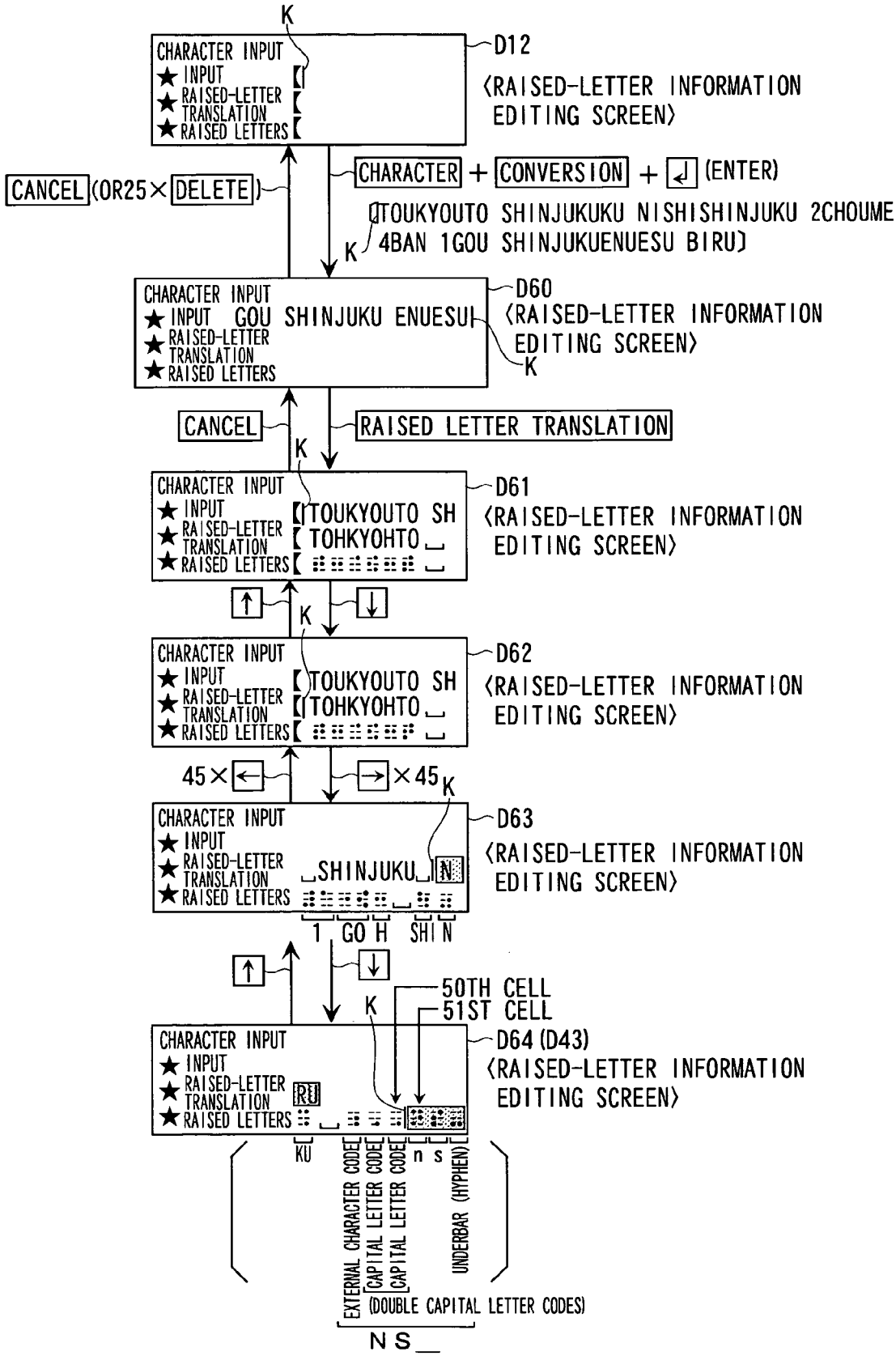
FIG. 17 is a diagram showing operations in inputting/editing raised-letter information in a fourth example according to this invention.

In this case, for example, as shown in FIG. 17, from the initial state of the above-described raised-letter information editing screen in FIG. 10 (D12; in common to FIG. 10), once the user has inputted and determined, by using also kanji, katakana and alphabets, the ink character string: "tou-kyou-to-shin-juku-ku-nishi-shin-juku-2-chou-me-4-ban-1-gou-shin-juku-N-S-bi-ru", the user is prompted to input a character subsequent to the last character "ru" (D60).

Here, supposing the raised-letter translation key is depressed from the above-described state (D60), since the raised-letter translation character string and the raised letters are the same as those in the second example, the raised-letter string (katakana and the like) "toh-kyoh-to - - - <partly omitted> - - - shi-n-ju-ku N-S-bi-ru" is displayed in the "raised-letter translation" field, and the corresponding cell images are displayed in the "raised-letter" field. Then, in order to facilitate the verification of the inputted ink character string, the cursor K is moved to the front of the top of the ink character string, i.e., the "tou" (kanji), to thereby prompt the user to verify the ink character string (D61).

Similarly to the third example, the cursor is moved to the "raised-letter translation" field from the start (D62), and when cursor is moved while making a check of the "input" field, the "raised-letter translation" field, and the "raised-letter" field, it is verified that the "N" in the tail "N-S bi-ru" in the raised-letter translation character string and the portion subsequent thereto is an excess portion (excess raised-letter translation character string; excess notation character string), based on this portion being halftone-displayed (D63). Furthermore, for the verification of the "raised letter", when the cursor is moved to the "raised-letter" field, it can be verified that the cell images corresponding to the raised-letter translation characters "N" and the characters subsequent thereto are an excess portion, i.e., excess cell images (D64; the same as D43 in FIG. 15 in the second example).

Meanwhile, instead of performing an editing operation after having shifted the editing screen to a special editing screen for raised-letter input/editing as in the above-described examples (the first to fourth examples), the user may perform the raised-letter translation directly from ordinary text editing screens for editing ink characters. This case will be explained below as a fifth example.

Figure 18:
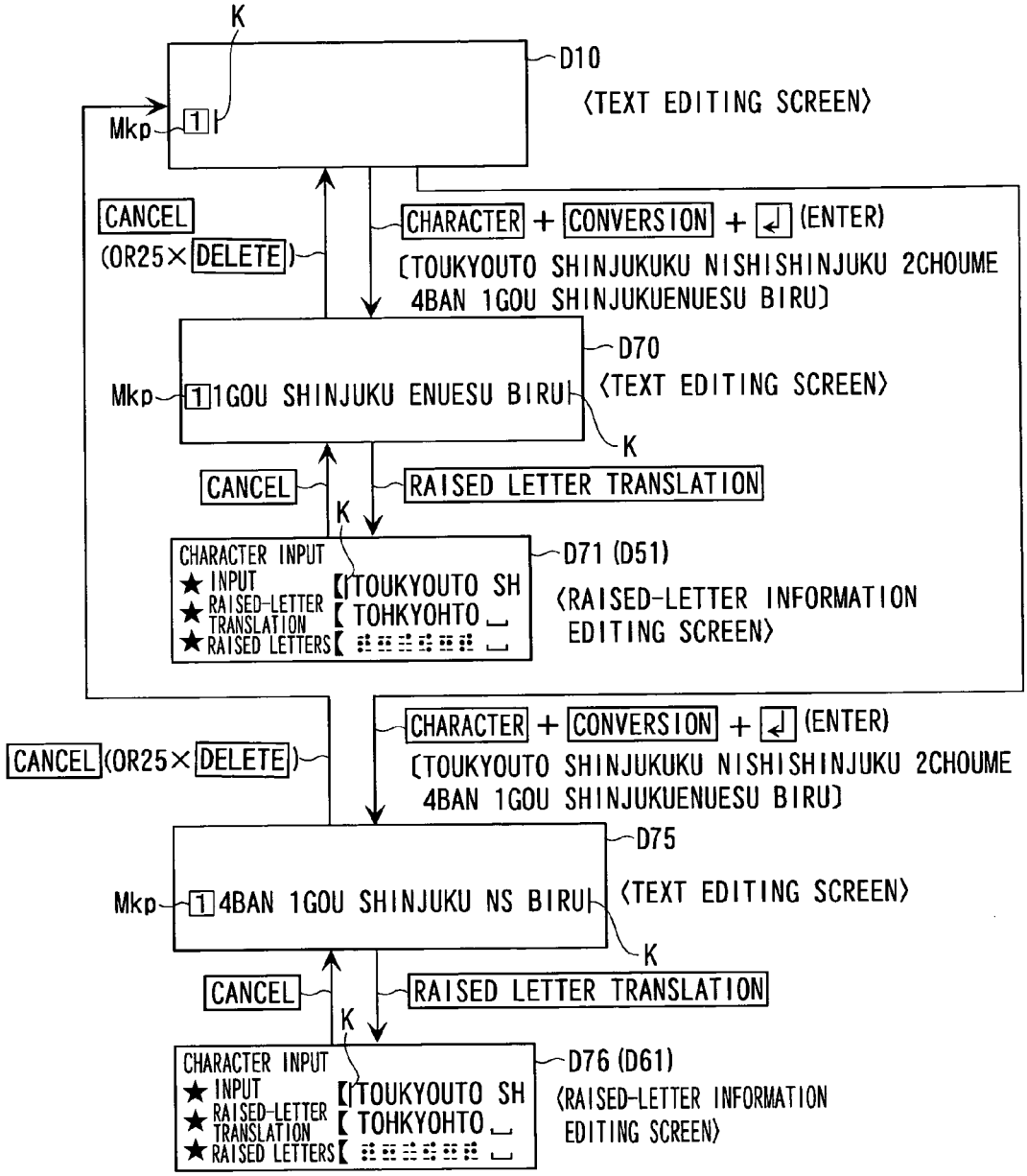
FIG. 18 is a diagram showing operations in inputting/editing raised-letter information in a fifth example according to this invention.

In this case, for example, as shown in FIG. 18, in the above-described text information editing screen (D10; in common to FIG. 10), once the user has inputted and determined, by using also kanji and katakana, the ink character string: "tou-kyou-to - - - <partly omitted> - - - shi-n-ju-ku e-nu-e-su-bi-ru" has been inputted and determined, the user is prompted to input a character subsequent to the last character "ru" (D70). Supposing the raised-letter translation key is depressed from this state, since the raised-letter translation character string and the raised letters are the same as those in the first example, the raised-letter translation character string (katakana and the like): "toh-kyoh-to - - - <partly omitted> - - - shin-ju-ku enu-esu bi-ru" is displayed in the "raised-letter translation" field, and the corresponding cell images are displayed in the "raised-letter" field. Then, the cursor K is moved to the front of the top of the ink character string, i.e., the "tou" (kanji), to thereby prompt the user to verify the ink character string (D71; the same as D51 in FIG. 16 in the third example). Because subsequent operation is the same as that in the third example, description thereof is omitted.

Also, in the text information editing screen (D10), when, by using also kanji, katakana, and alphabets, the ink character string: "tou-kyou-to - - - <partly omitted> - - - shin-ju-ku N-S-bi-ru" is inputted and determined, the user is prompted to input a character subsequent to the last character (katakana) "ru" (D75). Supposing the raised-letter translation key is depressed from this state, since the raised-letter translation character string and the raised letters are the same as those in the second example, the raised-letter translation character string (katakana and the like): "toh-kyoh-to - - - <partly omitted> - - - shin-ju-ku N-S bi-ru" is displayed in the "raised-letter translation" field, and the corresponding cell images are displayed in the "raised-letter" field. Then, the cursor K is moved to the front of the top of the ink character string, i.e., the "tou" (kanji), to thereby prompt the user to verify the ink character string (D71; the same as D51 in FIG. 16 in the third example). Because subsequent operation is the same as that in the fourth example, description thereof is omitted.

Meanwhile, instead of performing a raised-letter translation from character inputs as in the above-described examples (the first to fifth examples), the user can directly input/edit raised letters by cell images. This case will be explained below as a sixth example.

Figure 19:
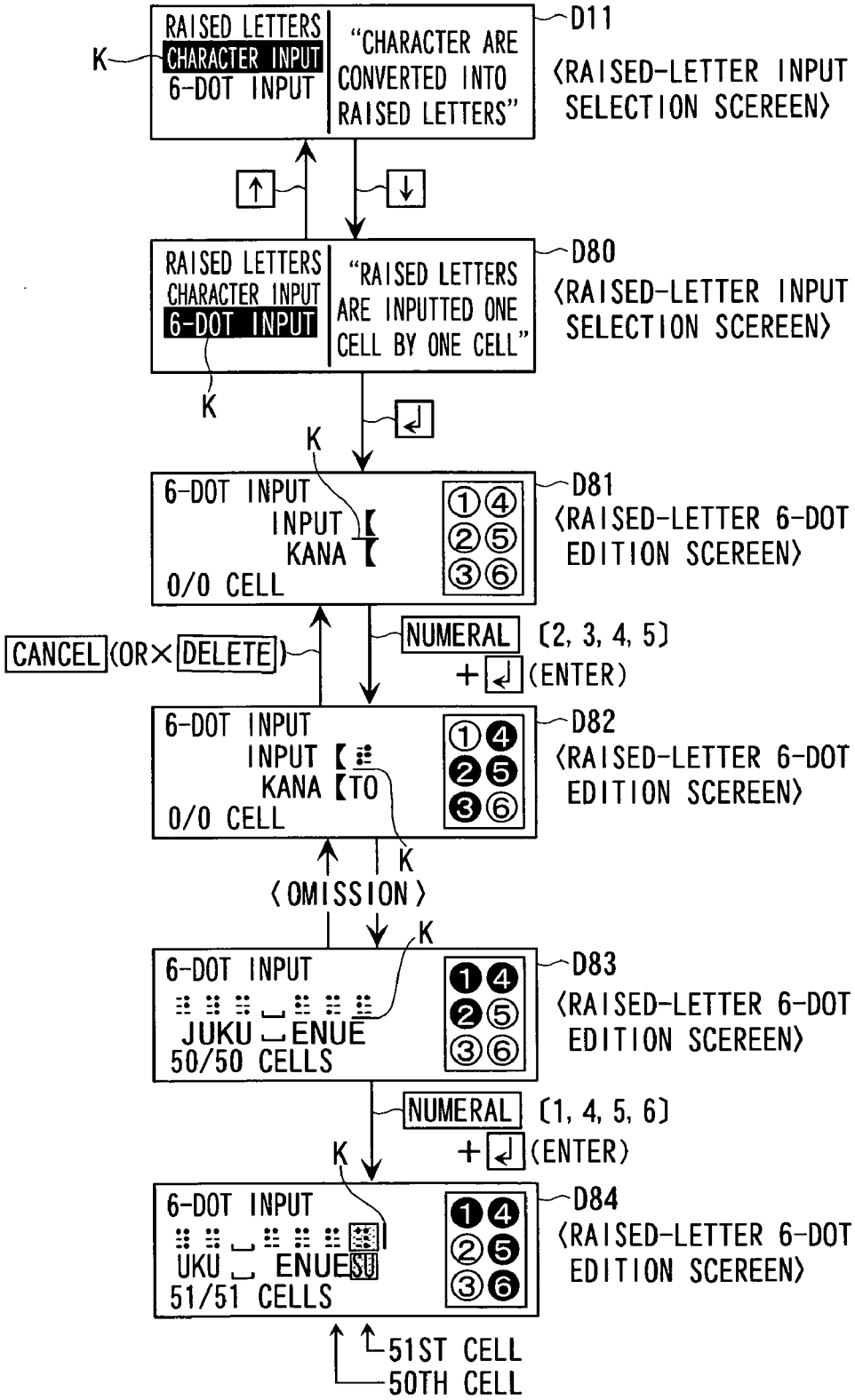
FIG. 19 is a diagram showing operations in inputting/editing raised-letter information in a sixth example according to this invention.

In this case, for example, as shown in FIG. 19, in the above-described raised-letter input selection screen (D11; in common to FIG. 10), supposing "six-dot input" is selected/determined (D80), "six-dot input" is set as a raised-letter inputting method (raised-letter input mode), and then, the editing screen shifts to an editing screen (raised-letter six-dot editing screen; second level) for inputting/editing raised letters by the embossed dot designation (D81).

In this editing screen, embossed dots in each raised-letter cell can be designated by the dot number 1 to 6 corresponding to dot 1 to dot 6. For example, when numeric keys "2, 3, 4, and 5" are depressed, it is indicated that the dots 2, 3, 4, and 5 have been designated (inputted), by varying the displays of respective dot numbers in marks "○" on the right side on the screen, as well as by moving the cursor K to the right side of "[" in the "input" field to display the cell image of the corresponding raised letter by a black-white inversion indicative of a non-determined state. Once the user determines it (depresses the enter key) after having checked it, the cell image of the raised letter is displayed in a line in the "input" field, i.e., a raised-letter line, and a character corresponding to the raised letter, i.e., a raised-letter translation character (kana) "to" (in the "toh") in a "kana" field, i.e., raised-letter translation line (D82).

Likewise, for example, the same cell image as that of the raised letter in the first example is inputted by the embossed dot designation, and here, when, from the state where the raised-letter translation character string in the "kana" field has been inputted up to " . . . e-nu-e" in the characters (katakana) "e-nu-e-su bi-ru" (D83), numerals "1, 4, 5, and 6" are further inputted/determined by the embossed dot designation, the cell image of the designated raised letter is displayed in the raised-letter line, and the "su" (katakana) corresponding to the designated raised letter is displayed in the raised-letter translation line. However, because the cell corresponding to the "su" constitutes the 51st cell, i.e., it is in excess of the maximum cell number, it is halftone-displayed (D84). As a result, the user can grasp, at this point of time, that the cell number is in excess of the maximum cell number.

As described above, displayed in the label producing apparatus 1 are: the raised-letter cell images (the "raised-letter" fields in the first to fifth examples in FIG. 10 and FIGS. 13 to 18; the "input" field in the sixth example in FIG. 19; and the corresponding notation character strings (the ink character strings in the "input" fields in the first to fifth examples (figures: ditto); the raised-letter translation character strings (examples, and figures: ditto); and the raised-letter translation character strings in the "kana" field in the sixth example (figure: ditto)). Out of these, the excess cell images corresponding to the portion exceeding the maximum cell number (i.e., excess portion) and the corresponding excess notation character string are displayed distinguishably from the other portion (in this embodiment, a halftone display is adopted).

Therefore, the user can easily and correctly grasp whether the cell number is in excess of the maximum cell number, or how much the cell is in excess of the maximum cell number, by the display, during raised-letter information editing performed before actual raised-letter embossing, without taking a lot of time and effort for calculation or count of the cell number. This saves the user from having to do the editing operation again after the actual embossing, thereby providing enhanced operability.

When the cell number is in excess of the maximum cell number, it is possible not only to perform the above-described display of excess portion, but also to give an error notice by beep sounds or a message. This desirably ensures a sufficient notice.

As a method of displaying the excess portion distinguishably from the other portion, this embodiment uses halftone display. However, the kind of "halftone display" is not limited as long as it can distinguishably the display excess portion. Also, the mehod of the excess portion may include so-called character decorations other than halftone, such as an underline, upper-line, enclosing mark, fill, hollowing-out, black-white inversion, shadowed character, character color change, and in addition, it may also include the changing of background color or background pattern.

In this embodiment, there is a possibility that the embossing member 81 (embossing means) of the embossing unit 80 in the raised-letter embossing section 150 raise the ambient temperature by its heating or the like occurring during operation, and therefore, in order to restrain the ambient temperature within a predetermined temperature, the maximum cell number is predetermined as 50 with consonance with safety securing. In other words, the maximum cell number is defined so as to serve the purpose of securing the safety of the raised-letter embossing (i.e., avoidance of danger by raised-letter embossing), and hence complying with this maximum cell number enables this purpose to be fulfilled. Although in this embodiment, heating is taken as a main factor determining the maximum cell number, restrictions based on the maintenance of embossing function and avoidance of danger thereby, can also constitute factors determining the maximum cell number.

As described above, in this embodiment, the maximum embossed cell number is predetermined, and excess cell images corresponding to the portion exceeding the maximum embossed cell number and/or a corresponding excess notation character string is displayed distinguishably from the other portion. By this display, therefore, it is possible to easily and correctly grasp whether the number of the raised-letter cells is in excess of the maximum embossed cell number, or how much the number of the raised-letter cells is in excess of the maximum embossed cell number, thereby providing enhanced operability.

As shown in the above-described sixth example, by the embossed dot designation (the designation of embossed dots or non-embossed dots in dot units), the raised letters can be easily edited, as well as the editing result can be caused to be reflected in cell images (in the "input" field) and raised-letter information raised-letter information such as a notation character string (in the "kana" field). Therefore, by recognizably displaying excess cell images and/or an excess notation character string, it is possible to easily and correctly grasp, by the display, whether the cell number is in excess of the maximum cell number, and to edit raised-letter information with consideration given to the restrictions on the maximum cell number, thereby providing high operability.

As the above-described first to fifth examples, it is possible to edit the notation character string including the ink character string (in the "input" field) for sighted persons, and the raised-letter string (in the "raised-letter translation" field) based the raised-letter specifications.

In the first to fifth examples, mainly the ink character string was edited and caused to be reflected in the raised-letter translation character string, but by moving the cursor to an arbitrary position in the raised-letter translation character string, it is possible to arbitrarily edit the character or raised-letter translation character string in the position. In the sixth example also, the raised-letter side ("input" field side) was edited by the embossed dot designation and the editing result was caused to be reflected in the raised-letter translation character string side ("kana" field side), but if the raised-letter translation character string is directly edited and the editing result is caused to be reflected in the raised-letter side, the same effect as that in the fist to fifth examples could be produced.

That is, by editing the ink character string and causing the editing result to be reflected in the raised-letter string, or causing the change in the raised-letter string as the result of the editing to the cell images, or by directly editing the raised-letter string and causing it to be reflected in the cell images, it is possible to edit cell images (namely, raised-letter information expressed by them) on an indirect or a direct basis. When the cell number is in excess of the maximum cell number, since the excess portion (excess cell images or excess notation character string) can be distinguished by the display, even without knowledge of the cell configuration of raised letters, the editing of raised-letter information with consideration given to the restriction on the maximum cell number of raised letters, thereby providing even higher operability.

In each of the above-described examples, the maximum cell number was explained as a factor in determining the function maintenance and safety securing. However, it is also possible to determine the maximum cell number based on other restrictions on the specifications, such as a restriction based on the length of fixed-length (or definite length) processing sheet, the size of screen for display screen, the storage capacity of image, or the like.

For example, supposing the case where an arrangement length for arranging or disposing raised letters (raised-letter cells) is set on a tape (processing sheet) T, the maximum number of the cells that can be arranged on the arrangement length, i.e., maximum arranged cell number is determined based on this arrangement length. This also holds true for a processing sheet having a wide area instead of tape T. In this case, if an arrangement area where raised letters are to be arranged, is set on the processing sheet, the maximum arranged cell number that can be arranged as raised letters in a line depends on the length (width) of the arrangement area in the lateral direction longitudinal direction in each line.

However, because in this embodiment, the label producing apparatus 1 performing ink character printing and raised-letter embossing on the tape T has been exemplified, the case where a label having a length set by the definite length setting is produced, is now described below, as a second embodiment.

Second Embodiment

While the above-described first embodiment includes the first to sixth examples, the second embodiment comprises a seventh example. As described above, in the first embodiment, the "maximum cell number" can be referred to as a "maximum arranged cell number", because it is the maximum number of cells that can be arranged within the length of the arrangement area where raised letters are to be arranged. In the second embodiment described hereinafter, in keeping with the first embodiment, or interpreting the cell number as the maximum number of cells on which raised letters can be embossed within the arrangement length), it is assumed that (maximum cell number)=(maximum embossed cell number).

First, in the label producing apparatus 1 according to this embodiment of this invention, it is assumed that the definite length setting be possible. When the definite length setting is made, the tape T is cut (full cut) to the definite length to produce the definite length label. Here, the method and operation for the definite length setting and the like are omitted from description because they are well-known. It is here assumed that a definite setting interruption occur after the definite length setting has been completed, and perform processing thereafter.

Figure 20:
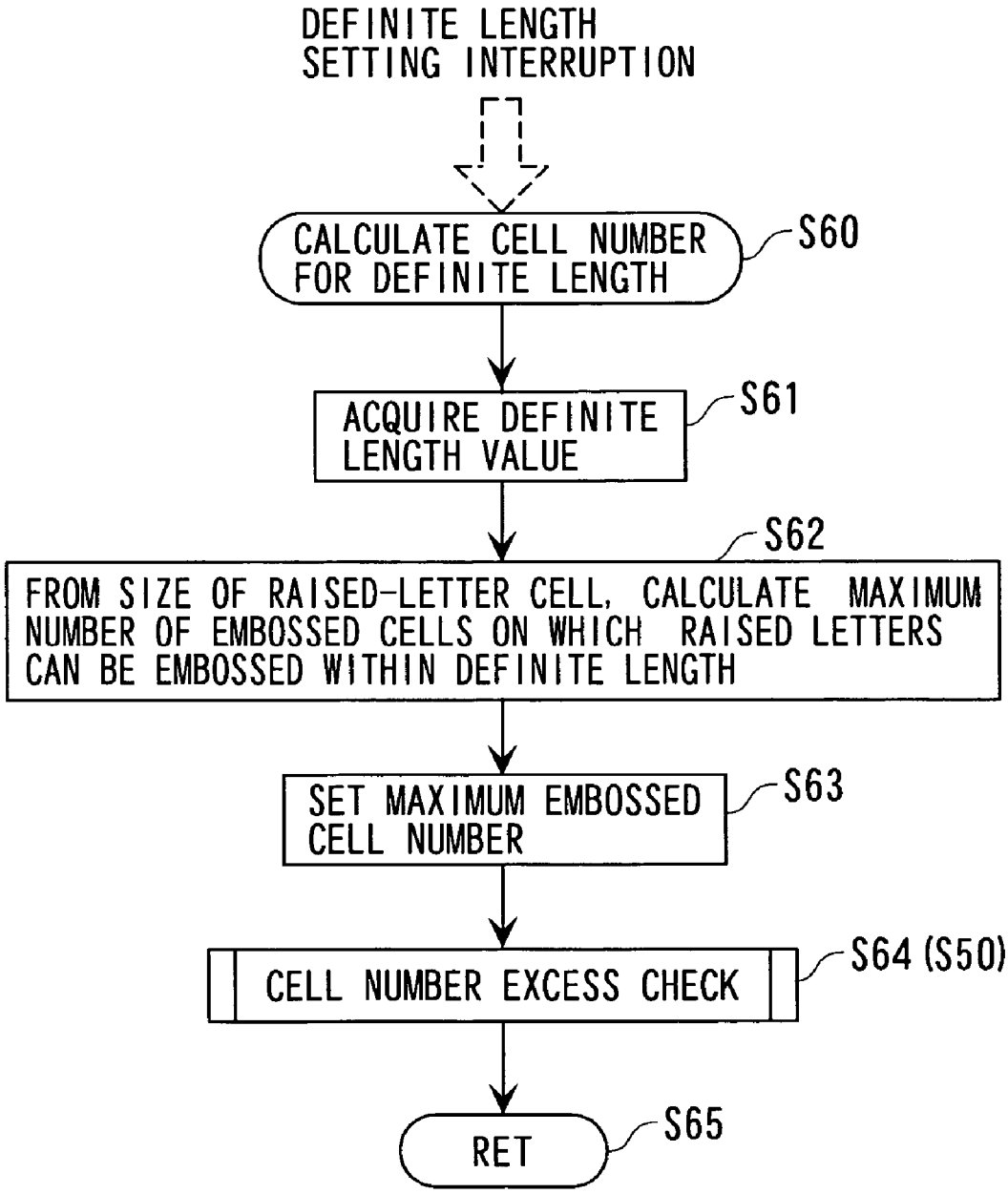
FIG. 20 is a flowchart of the calculation processing with respect to the number of cells for a definite length.

Processing shown in FIG. 20 is also a kind of the above-described processing. Once the definite setting interruption occurs after the definite length setting has been completed, cell number calculating processing for definite length (S60) is activated.

As shown in FIG. 20, in this cell number calculating processing for definite length (S60), firstly a set definite length value is acquired (S61), and based on the size (see FIG. 4A) of raised-letter cell, the maximum embossed cell number (maximum arrangement cell number) that can be embossed (arranged) within the definite length value, is calculated (S62). From the calculation result, a maximum embossed cell number is set or renewed (S63). Here, for example, it is regarded that the new (renewed) maximum embossed cell number=30.

After this, in the same way as the raised-letter translation processing (S40) described in FIG. 11, cell number excess check processing (S42) is performed, that is, the cell number excess check processing (S50) described in FIG. 12 is performed by generating the raised-letter editing interruption, thereby completing the processing (S65).

In this case also, upon occurrence of the raised-letter editing interruption, the cell number excess check processing (S50) described in FIG. 12 is activated. Specifically, if the cell number of raised-letter under editing is not in excess of the maximum embossed cell number, the determination in S51 is "No", and the processing ends (S55). On the other hand, if the cell number is in excess of the maximum embossed cell number, the determination in S51 is "Yes". Next, the character corresponding to the (maximum embossed cell number+1)th cell, i.e., (30+1=31)st cell is searched for (S52), and the images of the 32-nd cell and the cells subsequent thereto are halftone-displayed (S53). Also, the character corresponding to the above-described 31-th cell and the characters subsequent thereto are halftone-displayed (S54), thereby completing the processing (S55).

As described above, in the label producing apparatus 1 according to the second embodiment, the definite length (arrangement length for arranging raised letters on a processing sheet) in the definite setting is set. However, since the size of raised-letter cell and the distance between raised-letter cells cannot be adjusted, the maximum embossed cell number (maximum arranged cell number) based on the range length is predetermined. Therefore, excess portion exceeding the maximum embossed cell images (excess cell images or excess notation character string) can be distinguished from the other portion by a display. Thereby, it is possible to easily and correctly grasp, by the display, whether the arranged cell number is in excess of the maximum arranged cell number, or how much the arranged cell number is in excess of the maximum arranged cell number, thereby providing enhanced operability.

In the above-described second embodiment, because the maximum embossed cell number is a maximum cell number based on the limitation of the arrangement length of raised letters, the raised-letter embossing limitation may be taken as a cell number limitation (maximum arrangement cell number). However, in the first embodiment, since the cell number limitation is a limitation determined from the viewpoint of the safety securing in the solenoid 47 in the embossing unit 80, the cell limitation (maximum embossed cell amount) in this case can be regarded as a limitation on the embossing amount (continuous embossing amount) in continuous embossing, i.e., the maximum continuous embossing amount, or can be regarded as a limitation on the continuous operation amount (maximum continuous operation amount) in a sense of being the operation of the embossing unit 80.

From the viewpoint of this maximum continuous embossing amount and the like, the load (embossing amount; operation amount) is definitely different between the case where the cell of Raised-letter representing "a" (kana)[dot 1 alone is an embossed dot, i.e., embossed dot number is one] is consecutively repeated, and the case where the cell of raised letter representing "me" (kana)[dots 1 to 6 are all embossed dots, i.e., embossed dot number is six) is consecutively repeated. Therefore, a concept that limiting the continuous embossing amount by the number of embossed dots (hereinafter, "embossed dot number") is proper rather than simply limiting the continuous embossing amount by the cell number, would hold.

Accordingly, an example in which, instead of the cell number limitation (maximum embossed cell number), the embossed dot number limitation (maximum embossed dot number) is used, and the portion exceeding the maximum embossed dot number (e.g., given 300 dots, the cell (six dots) of "me" (kana) can be embossed 50 times) is indicated, will be described below as a third embodiment (eighth example).

Third Embodiment

However, in this case also, since raised letters are to be searched for in cell units, a cell including at least one embossed dot exceeding the maximum embossed dot number is searched for, and this cell and the cells subsequent thereto are clearly shown (halftone display). Also, the characters corresponding to the one cell that has been searched for, or a plurality of cells including the one cell are searched for, and then the characters that has been searched for and the characters subsequent thereto are clearly shown (halftone display).

Figure 21:
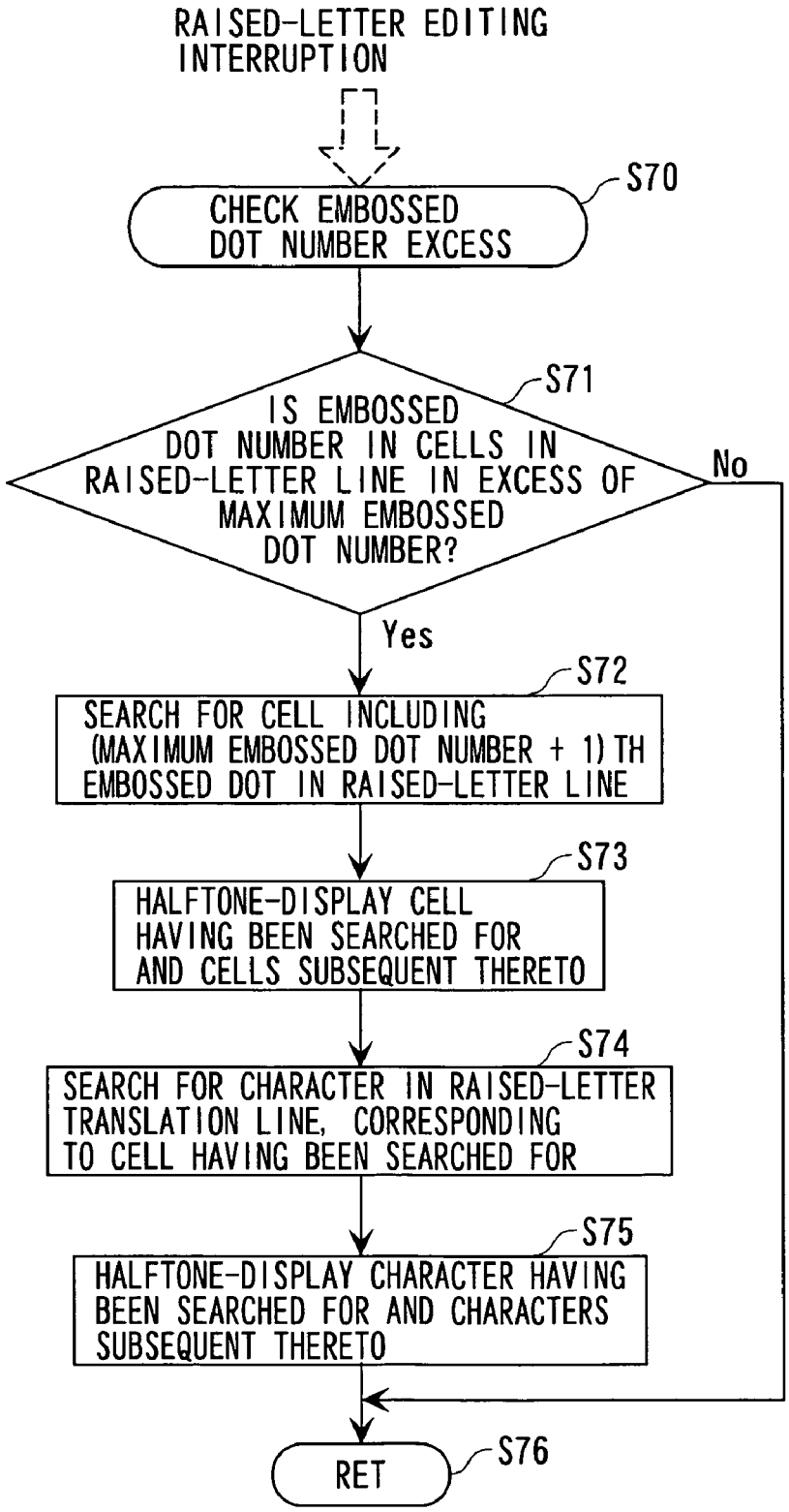
FIG. 21 is a flowchart of embossed dot excess check processing according to this invention.

In this case, upon occurrence of the raised-letter editing interruption, the embossed dot number excess check processing (S70) shown in FIG. 21 is activated.

As shown in FIG. 21, in this embossed dot number excess check processing (S70), firstly the embossed dot number of raised-letter cells under editing is checked, and it is determined whether the embossed dot number is excess of the maximum embossed dot number (S71). If the embossed dot number is not in excess of the maximum embossed dot number, the determination in S71 is "No", and the processing ends (S76).

On the other hand, if the embossed dot number is in excess of the maximum embossed dot number, the determination in S71 is "Yes". Next, the cell including the (maximum embossed dot number+1)th embossed dot in the raised-letter line is searched for (S72), and the cell that has been searched for and the cells subsequent thereto are halftone-displayed (S73). Then, the character corresponding to the character that has been searched for and the characters subsequent thereto are halftone-displayed (S75), thereby completing the processing (S76). Thereby, the portions in the raised-letter translation line and raised-letter line, each exceeding the maximum embossed dot number are halftone-displayed as excess portions.

As described above, in this embodiment, the maximum embossed dot number based on the limitation on the embossed dot number is predetermined, and portion exceeding it (excess cell images or excess notation character string) can be distinguished from the other portion by a display, it is possible to easily and correctly grasp, by the display, whether the embossed dot number is in excess of the maximum embossed dot number, or how much the embossed dot number is in excess of the maximum embossed dot number, thereby providing high operability.

From the viewpoint of the above-described maximum continuous embossing amount and the like, a concept that limiting the continuous embossing amount by the embossing time (operation time) with the solenoid 47 used is proper rather than limiting the continuous embossing amount by the above-described embosses cell number and embossed dot number, would hold. Accordingly, an example in which portion exceeding the embossing time limitation (maximum embossing time) is indicated, will be described below, as a fourth embodiment (ninth example). However, in this case also, the raised letters are searched for in cell units, and the characters are searched for in character units. Their respective portions exceeding the maximum embossing time are clearly shown (halftone display).

Fourth Embodiment

Figure 22:
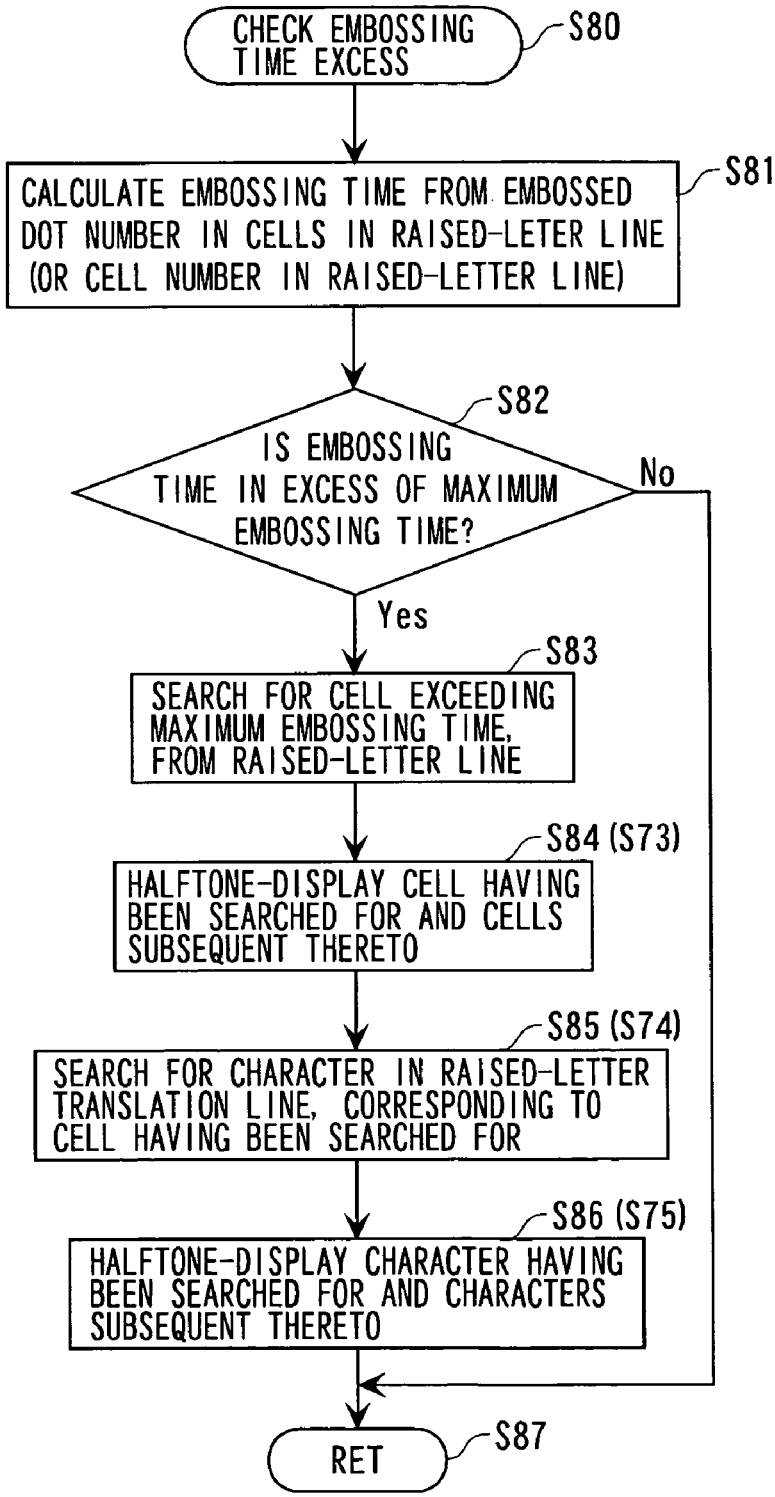
FIG. 22 is a flowchart of embossing time excess check processing according to this invention.

In this case also, upon occurrence of the raised-letter editing interruption, the embossing time excess check processing (S80) described in FIG. 22 is activated. In this embossing time excess check processing (S80), firstly, with respect to raised letters under editing, the embossed dot number in cells is checked as in the case of the second embodiment, or simply, the cell number is checked as in the case of the first embodiment, and thereby, from the embossed dot number or cell number based on the checking result, the embossing time is calculated by converting the embossed dot number or cell number into the embossing time (S81).

Next, it is determined whether the embossing time is in excess of the maximum embossing time (S82). If the embossing time is not in excess of the maximum embossing time, the determination in S82 is "No", and the processing ends (S87). On the other hand, if the embossing time is in excess of the maximum embossing time, the determination in S82 is "Yes". Next, a cell exceeding the maximum embossing time is searched for from the raised-letter line (S83). Thereafter, as in the case of above-described third embodiment in FIG. 21, the portions in the raised-letter translation line and raised-letter line, each exceeding the maximum embossing time are halftone-displayed as excess portions (S84 to S86; the same as S73 to S75 in FIG. 21), thereby completing the processing (S87).

As described above, in this embodiment, the maximum embossing time based on the limitation on the embossing time is predetermined, and portion exceeding it (excess cell images or excess notation character string) can be distinguished from the other portion by a display, it is possible to easily and correctly grasp, by the display, whether the embossing time is in excess of the maximum embossing time, or how much the embossing time is in excess of the maximum embossing time, thereby providing high operability.

The functions as the raised-letter information processing apparatus or various processing methods (raised-letter information processing method and the like) used in the above-described embodiments, are applicable as programs that are to be processed by various apparatuses capable of program-processing, and also applicable to various storage media for storing such kinds of programs. By storing these kinds of programs in advance or by reading them from the storage media and executing them, it is possible to edit raised-letter information with consideration given to the following restrictions: the maximum number of cells on which raised letters can be embossed (maximum embossed cell number; maximum arrangement cell number), the maximum continuous embossing amount of the raised-letter embossing means (maximum embossed cell cumber; maximum embossed dot number; maximum embossing time), and the like. This allows the achievement of enhanced operability.

A compact disk-read-only memory (CD-ROM), flash ROM, memory cards (compact-flash®, smart media, memory stick, etc.), a compact disk, magneto-optical disk, digital versatile disk, and flexible disk, etc. can be used as the above-described storage media. Storage media other than those described above may also be used as appropriate without departing from the spirit of the invention.

What is claimed is:

1. A raised-letter information processing apparatus comprising:

embossing means for embossing raised letters on a processing sheet, wherein a maximum continuous embossing amount that can be embossed on a single piece of the processing sheet has been predetermined;

determination means for determining a continuous embossing amount of raised letters under editing, and determining whether the continuous embossing amount is in excess of the maximum continuous embossing amount;

display means for displaying, on a display screen, cell images of the raised letters together with a notation character string corresponding to the cell images; and display control means that, when the continuous embossing amount is in excess of the maximum continuous embossing amount, causes the display means to display at least one of the excess cell images corresponding to the portion exceeding the maximum continuous embossing amount out of the cell images and the notation character string, and excess notation characters corresponding to the excess cell images so as to be distinguishable from a remaining portion.

2. The apparatus according to claim 1, wherein the embossing means uses a solenoid as a drivifig source; and wherein the maximum continuous embossing amount is predetermined based on the heating property of the solenoid.

3. The apparatus according to claim 1, wherein the maximum continuous embossing amount is defined as a maximum embossed cell number; and wherein the determination means comprising:

cell number acquisition means for acquiring, from the raised letters under editing, the cell number thereof;

cell number excess determination means for determining whether the acquired cell number is in excess of the maximum embossed cell number.

4. The apparatus according to claim 1, wherein the maximum continuous embossing amount is defined as the maximum number of embossed dots that can be continuously embossed; and wherein the determination means comprises:

embossed dot number acquisition means for acquiring, from the raised letters under editing, the cell number thereof;

embossed dot number excess determination means for determining whether the acquired embossed dot number is in excess of the maximum embossed dot number.

5. The apparatus according to claim 1, wherein the maximum continuous embossing amount is defined as the maximum embossing time during which continuous embossing can be performed; and wherein the determination means comprises:

embossing time calculation means for calculating, from the raised letters under editing, the embossing time during which they are embossed;

embossing time excess determination means for determining whether the calculated embossing time is in excess of the maximum embossing time.

6. The apparatus according to claim 1, wherein the processing sheet has a fixed length; and wherein the maximum continuous embossing amount is the maximum arranged cell number determined based on the fixed length.

7. The apparatus according to claim 1, further comprising:

arrangement length setting means for setting the arrangement length when arranging the raised letters under editing on the processing sheet, wherein the maximum continuous embossing amount is the maximum arranged cell number determined based on the set arrangement length.

8. A raised-letter information processing method in which cell images of raised letters under editing are displayed on a display screen, together with a notation character string corresponding to the cell images, the method comprising the steps of:

predetermining a maximum continuous embossing amount that can be embossed on a single piece of the processing sheet when embossing raised letters on the processing sheet; and determining a continuous embossing amount of the raised letters and when the continuous embossing amount is in excess of the maximum continuous embossing amount, displaying at least one of the excess cell images corresponding to the portion exceeding the maximum continuous embossing amount out of the cell images and the notation character string, and excess notation characters corresponding to the excess cell images so as td be distinguishable from a remaining portion.

* * * * *

UNITED STATES PATENT AND TRADEMARK OFFICE

CERTIFICATE OF CORRECTION

PATENT NO. : 7,278,792 B2
APPLICATION NO. : 11/245862
DATED : October 9, 2007
INVENTOR(S) : Takada et al.

It is certified that error appears in the above-identified patent and that said Letters Patent is hereby corrected as shown below:

On the title page, item 73, Add in the Assignee "KING JIM CO., LTD., Tokyo (JP)"

Signed and Sealed this

Twenty-third Day of June, 2009

JOHN DOLL
*Acting Director of the United States Patent and Trademark Office*